US012157200B2

(12) United States Patent
Höglund et al.

(10) Patent No.: US 12,157,200 B2
(45) Date of Patent: Dec. 3, 2024

(54) METHOD AND APPARATUS FOR FORMING A GROOVE PATTERN ON A CYLINDRICAL SURFACE

(71) Applicant: Mirka Ltd, Jepua (FI)

(72) Inventors: Göran Höglund, Nykarleby (FI); Hans Hede, Vörå (FI); Stefan Lindvall, Jepua (FI)

(73) Assignee: Mirka Ltd, Jepua (FI)

( * ) Notice: Subject to any disclaimer, the term of this patent is extended or adjusted under 35 U.S.C. 154(b) by 999 days.

(21) Appl. No.: 17/045,039

(22) PCT Filed: Apr. 8, 2019

(86) PCT No.: PCT/FI2019/050279
§ 371 (c)(1),
(2) Date: Oct. 2, 2020

(87) PCT Pub. No.: WO2019/197719
PCT Pub. Date: Oct. 17, 2019

(65) Prior Publication Data

US 2021/0154793 A1 May 27, 2021

(30) Foreign Application Priority Data

Apr. 10, 2018 (FI) ..... 20185341

(51) Int. Cl.
*B24B 19/02* (2006.01)
*B24B 5/40* (2006.01)
(Continued)

(52) U.S. Cl.
CPC ..... *B24B 19/028* (2013.01); *B24B 5/40* (2013.01); *B24B 19/02* (2013.01); *B24B 33/02* (2013.01);
(Continued)

(58) Field of Classification Search
CPC ..... B24B 19/02; B24B 19/028; B24B 5/40; B24B 33/05; B24B 33/06; B24B 49/16;
(Continued)

(56) References Cited

U.S. PATENT DOCUMENTS 1,902,194 A * 3/1933 Sunnen ..... B24B 33/089 29/DIG. 84
2,143,912 A 1/1939 Freborg et al.
(Continued)

FOREIGN PATENT DOCUMENTS

CN 101232973 A * 7/2008 ..... B24D 11/02
CN 107745328 A * 3/2018 ..... B24B 33/022
(Continued)

OTHER PUBLICATIONS

WO-2014072959-A2 espacenet (Year: 2024).*
(Continued)

*Primary Examiner* — Brian D Keller
*Assistant Examiner* — Tim Brady
(74) *Attorney, Agent, or Firm* — Meunier Carlin & Curfman LLC

(57) ABSTRACT

A method for producing a groove pattern on a cylinder surface includes providing an abrasive module, including an abrasive mesh article and collector block, providing a patterning head, which including the abrasive module and pressing actuator, pressing the abrasive module against the cylinder surface by using the actuator, forming a plurality of grooves on the cylinder surface by causing relative motion between the abrasive module and cylinder surface, and drawing gas through the abrasive mesh article to collect particles released from the cylinder surface. The abrasive mesh article includes a plurality of abrasive grains bonded to a flexible mesh backing, defining openings. The collector block has a curved supporting surface defining openings.
(Continued)

The abrasive mesh article is attached to the curved supporting surface by a releasable fastening system. The openings of the flexible mesh backing are in communication with the openings of the collector block via the releasable fastening system.

17 Claims, 23 Drawing Sheets

(51) Int. Cl.

| | |
|---|---|
| ***B24B 33/02*** | (2006.01) |
| ***B24B 33/05*** | (2006.01) |
| ***B24B 33/06*** | (2006.01) |
| ***B24B 33/10*** | (2006.01) |
| ***B24B 49/16*** | (2006.01) |
| ***B24B 55/06*** | (2006.01) |

(52) U.S. Cl.
CPC ..... *B24B 33/05* (2013.01); *B24B 33/06* (2013.01); *B24B 33/105* (2013.01); *B24B 49/16* (2013.01); *B24B 55/06* (2013.01)

(58) Field of Classification Search
CPC .. B24B 55/06; B24B 33/02; B24B 33/00–105
USPC ..... 451/51, 543, 61, 120, 124, 155
See application file for complete search history.

(56) References Cited

U.S. PATENT DOCUMENTS

| | | | | |
|---|---|---|---|---|
| 3,857,208 | A | 12/1974 | Harris, Jr. | |
| 4,945,685 | A | 8/1990 | Kajitani et al. | |
| 7,452,265 | B2 | 11/2008 | Rambosek et al. | |
| 2006/0223427 | A1* | 10/2006 | Tsumuraya | B24B 33/02 451/61 |
| 2011/0034115 | A1* | 2/2011 | Chao | B24D 9/08 451/490 |
| 2016/0144484 | A1* | 5/2016 | Simon | B24B 55/06 451/490 |
| 2017/0122247 | A1* | 5/2017 | Qin | C22C 38/12 |
| 2017/0183251 | A1* | 6/2017 | Forenz | B24B 27/0608 |
| 2018/0021916 | A1* | 1/2018 | Place | B24B 27/003 451/294 |

FOREIGN PATENT DOCUMENTS

| | | | | |
|---|---|---|---|---|
| DE | 10315218 | A1 * | 10/2004 | B23Q 17/2233 |
| DE | 102007017977 | A1 * | 6/2008 | B23K 26/00 |
| DE | 102011079757 | A1 * | 1/2013 | B21B 15/00 |
| DE | 102014212941 | A1 * | 1/2016 | B24B 33/02 |
| EP | 2157304 | A1 | 7/2013 | |
| EP | 3203059 | A1 * | 8/2017 | B24B 33/02 |
| FI | 45928 | B | 7/1972 | |
| JP | 2012051058 | A | 3/2012 | |
| WO | WO-2014072959 | A2 * | 5/2014 | B24B 19/26 |

OTHER PUBLICATIONS

EP-3203059-A1 espacenet (Year: 2024).*
DE-102007017977-A1 espacenet (Year: 2024).*
CN-101232973-A espacenet (Year: 2024).*
DE-102014212941-A1 espacenet (Year: 2024).*
DE-102011079757-A1 espacenet (Year: 2024).*
DE-10315218-A1 espacenet (Year: 2024).*
CN-107745328-A espacenet (Year: 2024).*
International Search Report for International Application No. PCT/FI2019/050279 mailed Jul. 11, 2019.
Written Opinion for International Application No. PCT/FI2019/050279 mailed Jul. 11, 2019.
Extended European Search Reporting dated Dec. 7, 2021 in corresponding Application No. 19785807.9 (9 pages).

* cited by examiner

Comparative Example

METHOD AND APPARATUS FOR FORMING A GROOVE PATTERN ON A CYLINDRICAL SURFACE

CROSS-REFERENCE TO RELATED APPLICATIONS

This application is a national stage application filed under 35 U.S.C. § 371 of PCT/FI2019/050279 filed Apr. 8, 2019, which claims priority to and benefit of Finnish patent application number 20185341 filed Apr. 10, 2018, the content of which is incorporated herein by reference in its entirety.

FIELD

The present invention relates to patterning of cylindrical surfaces. In particular, the present invention relates to forming a groove pattern on the inner surface of a cylinder of an internal combustion engine.

BACKGROUND

An internal combustion engine may comprise a piston moving in a lubricated cylinder. The inner surface of the cylinder may have a cross-hatch pattern of grooves formed by honing. The grooves may improve lubrication by retaining lubricating oil. The oil may be released from the grooves during operation of the engine, to reduce the friction between the piston and the cylinder.

The honing operation typically comprises using a honing head, which comprises several abrasive stones and a pressing mechanism. The pressing mechanism presses the abrasive stones against the inner surface of the cylinder with a suitable force. The honing head is simultaneously rotated and moved back and forth in the cylinder in order to produce a cross-hatch pattern on the inner surface of the cylinder.

Referring to FIG. 18, the conventional abrasive stone STONE1 is a rigid body, which typically comprises a plurality of randomly oriented abrasive grains AG0 fixed to an abrasive matrix. The abrasive grains are fixed to the abrasive matrix of the stone by one or more bonding materials. The rigid abrasive matrix comprises the abrasive grains and the bonding material.

The honing separates metal particles from the cylinder wall. The sharp edges of the abrasive grains may become dull and may fracture. The abrasive stone is typically selected such that the abrasive stone erodes during operation, so as to continuously expose new sharp abrasive grains. The abrasive stone may release abrasive particles and bonding material particles during the honing.

The particles may clog the abrasive stone, making the stone ineffective. A large particle trapped between the stone and the cylinder may damage the surface of the cylinder. Honing typically comprises using a honing oil for carrying away the released particles.

The honing stone may be cleaned by dressing and/or the geometric shape of the honing stone may be restored by dressing. The honing stone typically needs to be dressed during use and/or after use, to remove waste material from the surface of the honing stone. The dressing operation may need to be performed one or more times during processing of a cylinder. The dressing operation may slow down the production rate. Dressing of the conventional honing stone typically removes the sharpest and the highest abrasive peaks of the exposed grains of the honing stone. Some peaks of the exposed abrasive grains of the honing stone may be damaged due to the dressing operation.

U.S. Pat. No. 1,902,194 discloses a combination of a cylinder grinder and a dust collector. The cylinder grinder has abrasive elements adapted for linear contact with the cylinder wall. The dust collector comprises a casing within the margins of the abrasive elements. The casing comprises inlet openings adjacent to the abrasive elements for sucking dust and air into the casing.

U.S. Pat. No. 3,857,208 discloses a honing tool comprising a body forming a longitudinally extending outwardly opening slot therein, a carrier member disposed in said slot for radial sliding movement, means to move said carrier member radially to selected positions, an abrasive honing member, and means detachably connecting said abrasive honing member to said carrier member for movement therewith into and out of engagement with the bore of a workpiece.

SUMMARY

An object is to provide a method for forming a groove pattern on the surface of a cylinder. An object is to provide an apparatus for forming a groove pattern on the surface of a cylinder.

According to an aspect, there is provided a method for producing a groove pattern (PAT1) on a cylinder surface (SRF1), the method comprising:

providing an abrasive module (100), which comprises an abrasive mesh article (110) and a collector block (BLC1), the abrasive mesh article (110) being removably attached to the collector block (BLC1), providing a patterning head (HEAD1), which comprises the abrasive module (100) and a pressing actuator (140), pressing the abrasive module (100) against the cylinder surface (SRF1) by using the actuator (140), forming a plurality of grooves (G1) on the cylinder surface (SRF1) by causing relative motion between the abrasive module (100) and the cylinder surface (SRF1), and drawing gas (AIR1) through the abrasive mesh article (110) to remove particles (RP1) released from the cylinder surface (SRF1), wherein the abrasive mesh article (110) comprises a plurality of abrasive grains (AG1) bonded to a flexible mesh backing (MSH1), the collector block (BLC1) has a curved supporting surface (SRF3), the abrasive mesh article (110) is attached to the curved supporting surface (SRF3) by a releasable fastening system (HLSYS1), the flexible mesh backing (MSH1) comprises a plurality of first openings (OP1), the curved supporting surface (SRF3) comprises a plurality of second openings (OP3), and wherein the first openings (OP1) are in communication with the second openings (OP3) via the releasable fastening system (HLSYS1), for providing pathways for the released particles (RP1) from the first openings (OP1) to the second openings (OP3) via the releasable fastening system (HLSYS1).

According to an aspect, there is provided a method for producing a groove pattern on a cylinder surface according to claim 1.

According to an aspect, there is provided an apparatus for producing a groove pattern on a cylinder surface according to claim 14.

Further aspects are defined in the other claims.

The method and/or the apparatus may be arranged to form a groove pattern on the inner surface of a cylinder. The method and/or the apparatus may be arranged to form a groove pattern on the inner surface of a cylinder of an internal combustion engine. The inner surface of the cylinder may be the inner surface of a cylinder liner.

The apparatus may comprise one or more segmented collecting units, which have a cylindrical supporting surface. A piece of flexible abrasive mesh material may be removably attached to the cylindrical supporting surface e.g. by a hook and loop fastening system. The apparatus may comprise one or more abrasive modules such that each abrasive module comprises a collecting unit and a piece of flexible abrasive mesh material.

The outer radius of the abrasive module, when pressed against the inner surface of the cylinder, may be selected to correspond to the inner diameter of the cylinder. The outer radius of the collecting units may be selected according to the inner diameter of the cylinder and according to the thickness of the abrasive mesh material, so as to provide substantially uniform spatial distribution of grinding pressure.

The apparatus may comprise a patterning head, which comprises a group of abrasive modules attached to a common shaft. For example, the group may consist of two or three abrasive modules. The patterning head may comprise one or more actuators for pressing the abrasive modules against a cylinder surface.

The apparatus may comprise actuator units for performing a combined rotating and axial movement of abrasive modules with respect to a cylinder. The direction of the combined movement may be controlled with respect to the direction of the axis of the cylinder. The method may be used e.g. when the cylinder remains fastened to an engine.

The apparatus may comprise one or more actuator units for synchronizing an axial movement of (non-rotating) abrasive modules with a rotating movement of a cylinder. This embodiment may be used e.g. when the cylinder removed from the engine and when the cylinder is attached to a lathe.

The abrasive mesh material may comprise abrasive grains bonded to flexible backing mesh, which has a plurality of miniature openings. Particles released from the cylinder wall and/or particles released from the abrasive material may be sucked through the openings of the flexible backing mesh. The method may be substantially particle-free, i.e. the number of released particles falling to the bottom of the cylinder may be small or negligible.

Forming of the grooves may separate metal particles from the cylinder wall. A part of the abrasive grains of the abrasive mesh articles may be fractured and/or detached from the abrasive mesh articles. The method may comprise removing the released particles by drawing gas through the abrasive mesh articles. The released particles may be carried together with the gas flow through the abrasive mesh articles. The released particles may be collected from the cylinder surface by using the abrasive modules.

The apparatus may comprise a system for sucking released material particles from the grinding zone to a dust suction apparatus, during forming of the groove pattern. The released particles may be e.g. particles separated from the cylinder wall and/or abrasive grains detached from the abrasive mesh material.

The apparatus may comprise controllable actuators for changing the radial position of the abrasive modules, so as to facilitate insertion of the abrasive modules into a cylinder and/or so as to facilitate removal of the abrasive modules from the cylinder. The abrasive modules may be moved towards the axis of the patterning head of the apparatus so as to facilitate insertion of the abrasive modules into a cylinder. The actuators may press the abrasive modules against the cylinder during forming the groove pattern. The actuators may be e.g. pneumatic actuators. The actuators may press the abrasive modules with an adjustable and/or selectable pressing force.

The apparatus may comprise a programmable control unit for controlling operation of the apparatus. The control unit may control e.g. an axial start position of the patterning head, the orientation of the grooves of the groove pattern, the number of longitudinal strokes of the patterning head and/or the pressing force generated by the actuators. The rotational movement may have an angular velocity and the axial movement may have an axial velocity. A desired orientation of the grooves may be provided by setting the ratio of the angular velocity to the axial velocity.

The height and the width of the piece of the abrasive mesh material may be selected according to the dimensions of the cylinder and according to the desired orientation of the grooves, in order to optimize the production rate.

New pieces of abrasive mesh material may be easily attached to the supporting surfaces before forming the groove pattern. Sharp abrasive grains of the abrasive mesh material may become dull during forming of the groove pattern. Worn pieces of abrasive mesh material may be easily replaced with new ones to ensure efficient operation and consistent performance.

The abrasive grains of the abrasive mesh material may have controlled (erect) orientation, so as to form grooves which have a suitable depth to width ratio. The abrasive grains of the abrasive mesh material may have controlled (erect) orientation, so as to form grooves which have a suitable cross-sectional shape.

The number of the axial strokes of the patterning head may be selected e.g. in order to form a suitable density of grooves.

A desired shape of the grooves may be implemented by controlling the ratio of the angular velocity to the axial velocity. For example, the grooves may be substantially straight (when viewed from the axis of the cylinder), the grooves may have a sinusoidal form, or the grooves may have a zigzag form.

The pressing force generated by the actuators may be adjusted according to the axial position. For example, a predetermined pressing force may be intermittently switched on and off to form dashed grooves.

The groove pattern may be produced such that it consists essentially of inclined groove portions, which may provide optimum lubricating properties. The pressing force may be reduced to zero when the abrasive modules are near the end of the axial movement, e.g. in order to avoid producing horizontal groove portions. The apparatus may comprise a control unit, which may be configured to control the pressing force e.g. according to the axial position of the abrasive modules.

The method may comprise forming the grooves of the groove pattern by using larger abrasive grains, and the method may comprise removing remaining protrusions (e.g. burr) by using smaller abrasive grains. The processing of the cylinder surface may be performed in two steps, wherein the first step may comprise using first abrasive mesh articles to form grooves, and the second step may comprise using second abrasive mesh articles to remove the protrusions.

The cylinder may have an initial substantially smooth surface before forming the grooves with the abrasive modules. The method may allow producing a groove pattern on the cylinder surface such that the final surface of the cylinder has a sufficient number of deep microgrooves, wherein a large fraction of the surface may remain substantially smooth, and wherein the number of protrusions may be low. For example, more than 80% of the surface may remain substantially smooth after forming the groove pattern. For example, the microgrooves formed by using the abrasive modules may cover e.g. less than 20% of the total area of the produced groove pattern, wherein the depth of said microgrooves may be e.g. greater than 0.5 μm.

The present method may be used for producing a groove pattern on a smooth cylinder surface such that the smooth load-bearing surface portions between the adjacent grooves may be substantially preserved. The groove pattern may be formed in a short time, without substantially changing the radial dimensions of the cylinder surface.

Forming of the groove pattern may be performed as a dry method, i.e. without using a liquid between the abrasive mesh material and the cylinder surface.

When using the abrasive mesh, the pattering operation may be substantially dust-free. Substantially all metal particles and fractured abrasive grains may be effectively removed by a vacuum (suction) via the miniature openings of the abrasive mesh. The openings of the abrasive mesh may be distributed over the whole area of the abrasive mesh so that particles cannot escape. The released particles may be effectively extracted from the cylinder surface via the openings of the abrasive mesh.

Dry operation and suction of air through the abrasive mesh may allow effective removal of the released particles from the active working zone. Effective removal of the released particles may reduce the risk that particles trapped between the abrasive mesh and the cylinder surface would damage the cylinder surface. Effective removal of the released particles may ensure that the abrasive grains of the abrasive mesh may effectively form the desired groove pattern.

When using the abrasive mesh, the abrasive grains may be supported by the mesh structure in a slightly resilient manner, e.g. the individual grains or a small group of grains may rapidly follow the radial position of the surface of the cylinder.

The abrasive mesh may be advantageously produced such that the peaks of the abrasive grains of the abrasive mesh are substantially at the same height level. However, the abrasive mesh may sometimes comprise one or more high grains ("rider grains") which protrude with respect to the surrounding grains. The abrasive mesh may be arranged to at least partly compensate an effect of the high grains.

The abrasive mesh comprises a plurality of miniature openings, which do not have abrasive grains. The openings may reduce an average number density of abrasive grains (i.e. the average number of abrasive grains per unit area).

A total pressing force exerted by an actuator may be distributed to active grains of the abrasive mesh. Thus, the reduced number density of the abrasive grains may allow increasing the average pressing force per grain and/or may allow reducing the total pressing force. The upper surface of the abrasive mesh may comprise one or more grain-free regions (see e.g. FIG. 7*b*). The grain free regions may further reduce the effective number density of the abrasive grains.

The abrasive grains of an abrasive mesh article of the abrasive module may together span a considerable axial length and a considerable tangential width. The peaks of the abrasive grains may be understood to together define a cylindrical contact surface. The abrasive module may be understood to provide a surface contact instead of a linear contact. The angular width of the abrasive mesh article may be e.g. greater than 15°, greater than 30°, or even greater than 60° when viewed from the axis of the cylinder. The abrasive module may provide the surface contact because the flexible abrasive mesh may accurately conform to the cylinder surface and/or because the abrasive grains may be effectively pressed against the cylinder surface. The surface contact may improve stability. The surface contact may reduce vibrations.

Forming of the groove pattern may generate heat. The surface contact may help to keep the temperature of the cylinder surface below a predetermined limit, by distributing the heat to a larger area. The surface contact may help to keep the temperature of the grains below a predetermined limit, by distributing the heat to a larger area.

BRIEF DESCRIPTION OF THE DRAWINGS

In the following examples, several variations will be described in more detail with reference to the appended drawings, in which.

DETAILED DESCRIPTION

Figure 1A:
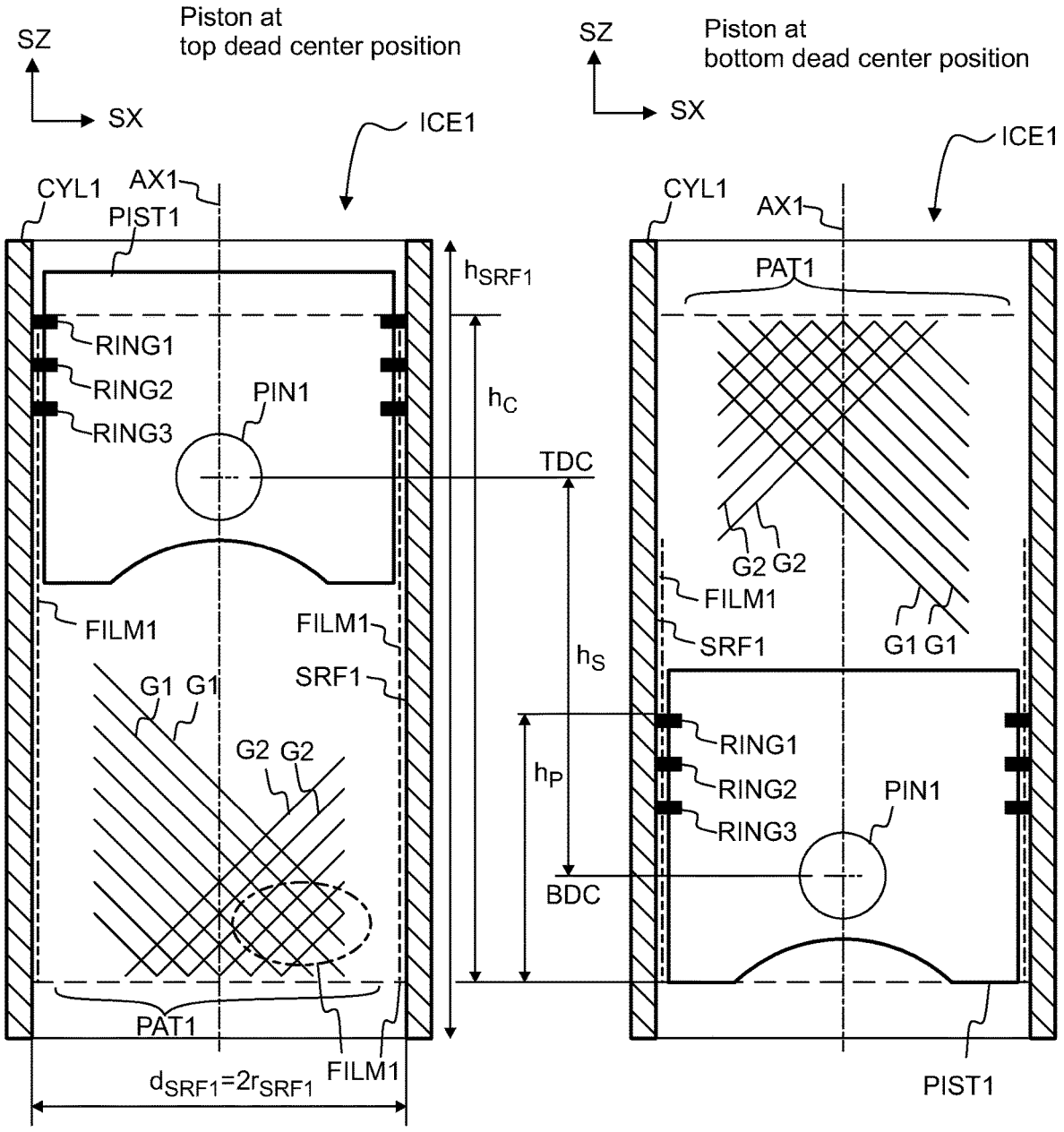
FIG. 1*a* shows, by way of example, the top dead center position and the bottom dead center position of a piston moving in a cylinder of an engine.

Referring to FIG. 1*a*, the patterning method may be used for forming a groove pattern PAT1 on the surface SRF1 of a cylinder CYL1. In particular, the groove pattern PAT1 may be formed on a cylinder CYL1 of an internal combustion engine ICE1.

An engine ICE1 may comprise a cylinder CYL1 and a piston PIST1. The piston PIST1 of the engine ICE1 may be arranged to move inside the cylinder CYL1. The engine ICE1 may be e.g. an internal combustion engine. The engine ICE1 may be arranged to operate such that the surface SRF1 is coated with a lubricating oil film FILM1 during operation of the engine ICE1. The surface SRF1 may comprise a plurality of grooves G1, G2 to retain lubricating oil during operation of the engine ICE1. The grooves G1, G2 may together constitute a groove pattern PAT1. The cylinder CYL1 may comprise a groove pattern PAT1 formed of a plurality of grooves G1, G2. The piston PIST1 may slide against the surface SRF1. The piston PIST1 may be in contact with the inner surface SRF1 of a cylinder liner and/or the piston PIST1 may be in contact with the lubricating oil film FILM1. The piston PIST1 may optionally comprise one or more piston rings RING1, RING2, RING3. For example, one or more rings RING1 and RING2 may be arranged seal the gap between the piston PIST1 and the surface SRF1. For example, one or more rings RING3 may be arranged to control the thickness of the oil film FILM1 formed of oil retained in the grooves G1, G2.

The reciprocating movement of the piston may be converted into a rotating movement of a crankshaft by using a connecting rod between the piston and the crankshaft. The piston may be connected to the connecting rod e.g. by a pin PIN1.

The inner surface SRF1 of the cylinder CYL1 may be substantially cylindrical and the inner surface SRF1 may have a central axis AX1. $d_{SRF1}$ denotes the inner diameter (bore) of the cylinder CYL1. The bore $d_{SRF1}$ is equal to two times the inner radius $r_{SRF1}$ of the cylinder CYL1.

The length $h_S$ of the stroke of the engine ICE1 means the distance travelled by the piston from the top dead center TDC to the bottom dead center BDC. $h_P$ may denote the distance between the uppermost ring RING1 and the bottom of the piston PIST1. To the first approximation, the height $h_C$ of a contact area may be substantially equal to the sum $h_S+h_P$. $h_{SRF1}$ may denote the total height of the inner surface of the cylinder CYL1.

SX, SY and SZ denote orthogonal directions. The axis AX1 of the cylinder may be parallel with the direction SZ.

Figure 1B:
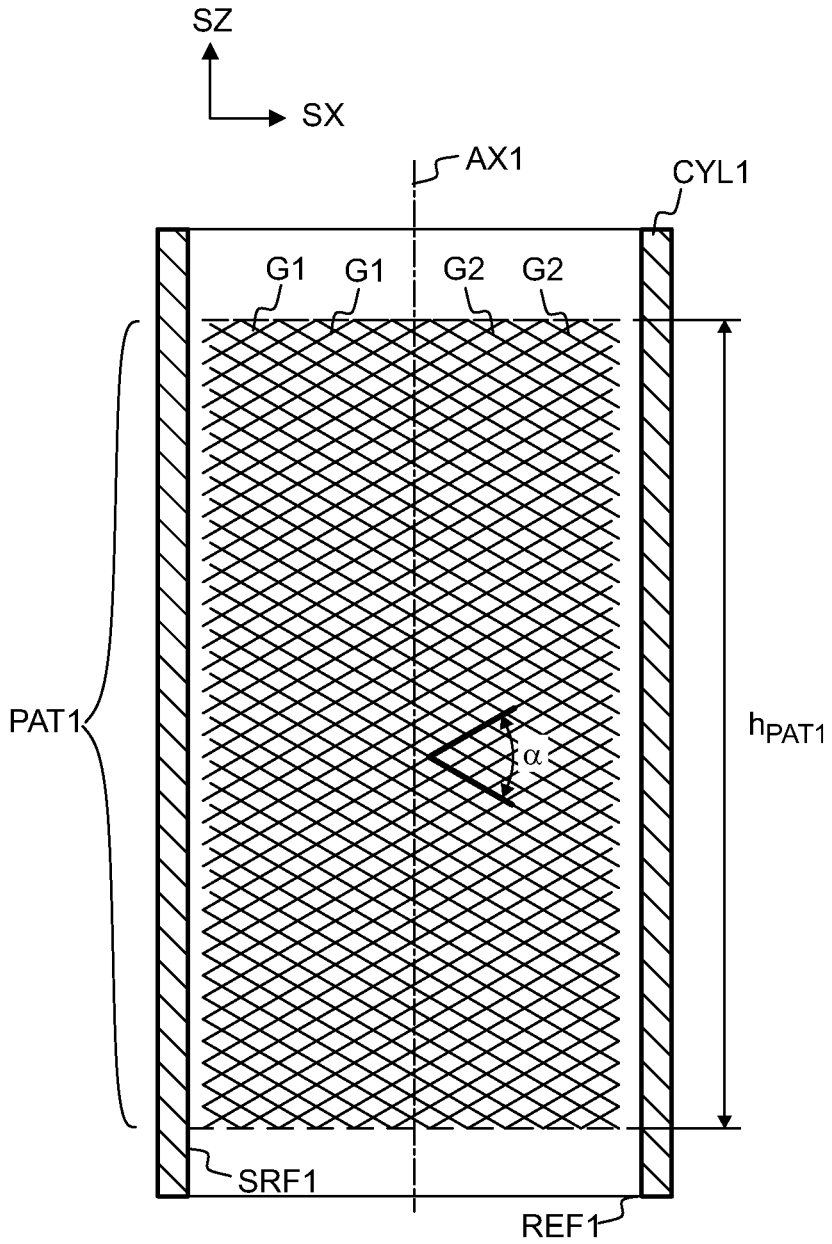
FIG. 1*b* shows, by way of example, a groove pattern of the cylinder.

Referring to FIG. 1*b*, the cylinder CYL1 may comprise the groove pattern PAT1. The groove pattern PAT1 of the cylinder CYL1 may have a height $h_{PAT1}$. The height $h_{PAT1}$ may be smaller than or equal to the height $h_{SRF1}$ of the cylindrical surface SRF1. The entire area may be patterned, i.e. the height $h_{PAT1}$ may be equal to the height $h_{SRF1}$ of the surface SRF1. Alternatively, an upper portion and/or a lower portion of the surface SRF1 may be left without the groove pattern PAT1. The height $h_{PAT1}$ may be smaller than the height $h_{SRF1}$ of the surface SRF1, e.g. in order to reduce the time needed for producing the groove pattern.

The orientation of the grooves G1, G2 of the groove pattern PAT1 may be specified e.g. by indicating the crosshatch angle α. The crosshatch angle α may also be called e.g. as the "honing angle". In case of a cylinder CYL1 of an internal combustion engine ICE1, the crosshatch angle α may be e.g. in the range of 10° to 120°, advantageously in the range of 30° to 80°.

The cylinder CYL1 may be produced from metal e.g. by machining. The cylinder CYL1 may be produced from metal e.g. by turning a piece of metal in a lathe. The initial shape of the surface SRF1 may be formed with conventional machining operations to a sufficient accuracy. The cylinder CYL1 may be produced e.g. from cast iron, steel or aluminum. In particular, the inner surface of the cylinder CYL1 may comprise cast iron or may consist of cast iron.

The cylinder CYL1 may be optionally coated with a wear resistant coating before forming the groove pattern or after forming the groove pattern PAT1. For example, a cast iron surface, a steel surface, an aluminum or a brass surface may be coated with a layer of (hard) chromium after forming the groove pattern PAT1. The coating may be applied e.g. by electroplating.

The cylinder CYL1 may be a cylinder of an engine ICE1. The engine ICE1 may be e.g. a diesel engine or a spark ignition engine. The engine may be e.g. a two-stroke engine or a four-stroke engine. The engine may be suitable for use as a main engine of a vehicle, a ship, or an airplane. The engine may be suitable for powering e.g. an electric generator. The engine may be a marine diesel generator. The fuel of the engine may be e.g. diesel oil, gasoline, alcohol and/or natural gas.

Figure 2:
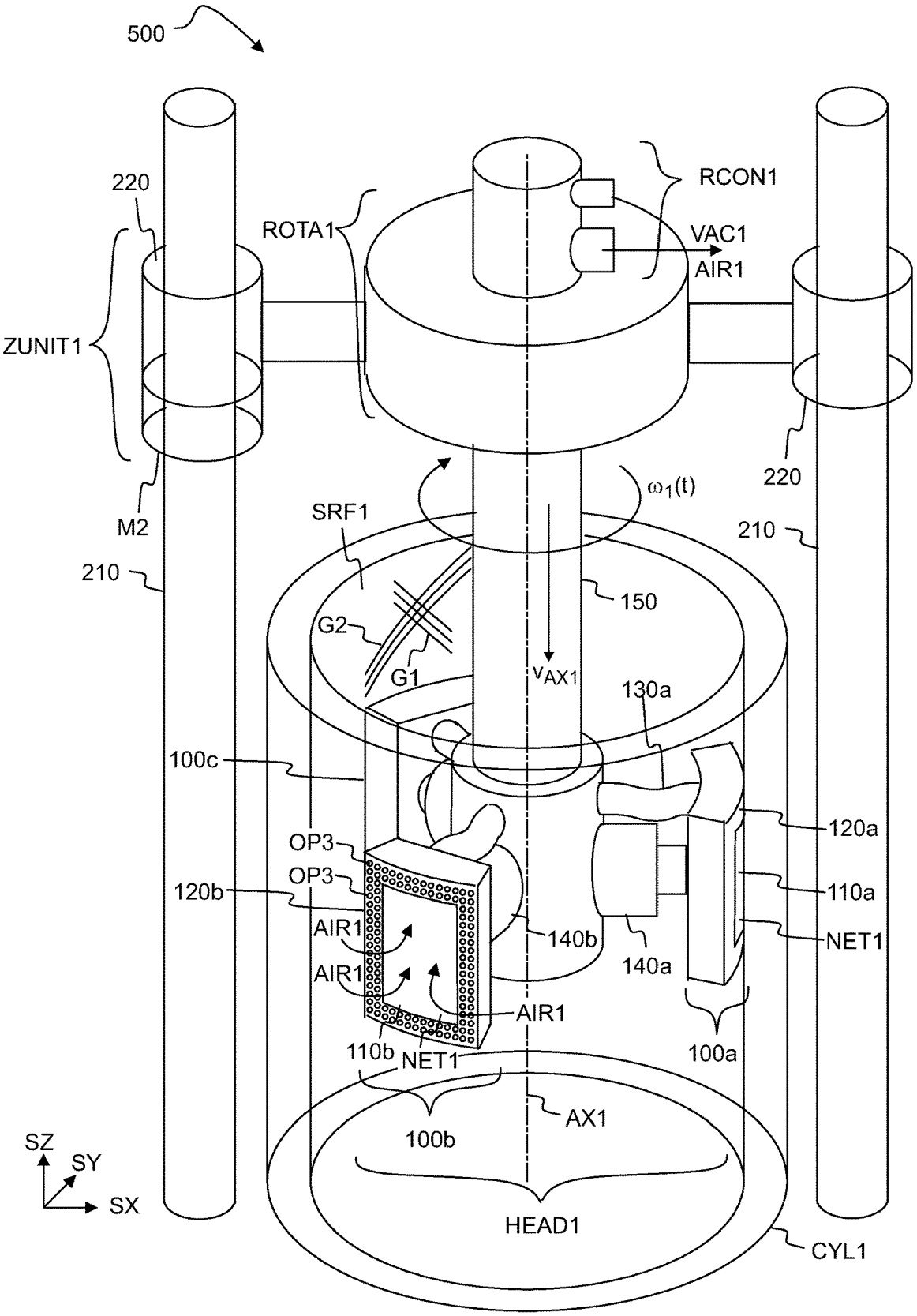
FIG. 2 shows, by way of example, in a three-dimensional view, an apparatus for forming a groove pattern on the inner surface of a cylinder.

Referring to FIG. 2, the groove pattern PAT1 may be formed on the surface SRF1 of the cylinder CYL1 by using one or more abrasive modules 100*a*, 100*b*, 100*c*.

An abrasive module 100*a*, 100*b*, 100*c* may comprise a piece 110*a*, 110*b*, 110*c* of flexible abrasive mesh NET1, which is attached to a collector unit 120*a*, 120*b*, 120*c*. The pieces 110*a*, 110*b*, 110*c* may be called as abrasive articles. The abrasive mesh NET1 may comprise a plurality of sharp and oriented abrasive grains. The abrasive modules 100*a*, 100*b*, 100*c* may be pressed against the cylinder surface SRF1 and moved along the surface SRF1 under the pressing force. Consequently, the abrasive grains may form the grooves G1, G2 by cutting the material of the cylinder CYL1.

A patterning head HEAD1 may comprise one or more abrasive modules 100*a*, 100*b*, 100*c* and one or more actuators 140*a*, 140*b*, 140*c* for pressing the modules against the cylinder.

The bore $d_{SRF1}$ of the cylinder CYL1 may be e.g. in the range of 40 mm to 1000 mm. The outer diameter of the patterning head HEAD1 may be e.g. in the range of 40 mm to 1000 mm, in a situation where the abrasive modules 100*a*, 100*b*, 100*c* are pressed against the surface SRF1.

Each module may be pressed by a different actuator. Several modules may be pressed by using the same actuator. All modules may be pressed by using the same actuator.

The number of the modules of the head may be e.g. in the range of 1 to 12, advantageously in the range of 3 to 6. The use of two or more modules may e.g. balance the pressing forces, and/or may allow processing of the surface SRF1 of the cylinder in a shorter time.

The patterning method may comprise causing relative rotational motion between the patterning head HEAD1 and the surface SRF1, and causing relative axial motion between the patterning head HEAD1 and the surface SRF1, wherein the rotational motion and the axial motion are performed simultaneously when the abrasive modules are pressed against the surface SRF1.

The patterning method may comprise causing a rotational movement of the patterning head HEAD1 with respect to the surface SRF1 and moving the patterning head HEAD1 in the axial direction of the surface SRF1 with respect to the surface SRF1.

The axis of rotation of the patterning head HEAD1 and/or the axis of rotation of the cylinder CYL1 may substantially coincide with the axis AX1 of the cylinder CYL1.

The relative motion between the patterning head HEAD1 and the cylinder CYL1 may be caused e.g. in one or more of the following ways.

The patterning head HEAD1 may be rotated with respect to stationary cylinder CYL1, and the patterning head HEAD1 may be moved in the direction of the axis AX1 of the cylinder with respect to the cylinder CYL1 (in the direction −SZ or in the direction +SZ).

The cylinder CYL1 may be rotated with respect to a non-rotating patterning head HEAD1, and the patterning head HEAD1 may be moved in the direction of the axis AX1 of the cylinder with respect to the cylinder CYL1.

The patterning head HEAD1 may be rotated with respect to a non-rotating cylinder CYL1, and the cylinder CYL1 may be may be moved in the direction of the axis AX1 of the cylinder with respect to the patterning head HEAD1.

The cylinder CYL1 may be rotated with respect to a stationary patterning head HEAD1, and the cylinder CYL1 may be may be moved in the direction of the axis AX1 of the cylinder with respect to the patterning head HEAD1.

A patterning apparatus 500 may comprise a patterning head HEAD1, a rotating unit ROTA1 for causing the relative rotational movement, and a positioning unit ZUNIT1 for causing the relative axial movement.

The rotating unit ROTA1 may be arranged to rotate the head HEAD1 with respect to the cylinder CYL1. The positioning unit ZUNIT1 may be arranged to change the axial position z of the head HEAD1 with respect to the cylinder CYL1.

The modules 100*a*, 100*b*, 100*c* may be rotated at an angular velocity ω1 about the axis AX1. The rotation speed of the patterning head HEAD1 may be equal to $\omega 1/(2\pi)$.

The rotating unit ROTA1 may comprise e.g. a motor M1 and a gear mechanism 250 for rotating the one or more abrasive modules 100*a*, 100*b*, 100*c* about the axis AX1. The motor M1 may be e.g. a stepper motor. The motor M1 may also be arranged to rotate the head HEAD1 without using a gear mechanism. The rotating unit ROTA1 may be e.g. a rotating table of a milling machine or a lathe, which may be arranged to rotate the cylinder CYL1.

The positioning unit ZUNIT1 may comprise e.g. carriage 220 and a motor M2 for moving the carriage 220 along a guideway 210. The modules 100*a*, 100*b*, 100*c* may be moved at an axial velocity $v_{AX1}$. The apparatus 500 may comprise one or more guideways 210, and the positioning unit ZUNIT1 may comprise one or more carriages 220 to move along one or more guideways 210. The motor M2 may be e.g. a stepper motor. The operation of the motor M2 may be synchronized with the operation of the motor M1. The positioning unit ZUNIT1 may also be implemented e.g. by using an industrial robot or an actuator of a milling machine.

Each abrasive module 100*a*, 100*b*, 100*c* may comprise a piece 110*a*, 110*b*, 110*c* of abrasive mesh NET1 removably attached to a collector unit 120*a*, 120*b*, 120*c*.

Each abrasive module 100*a*, 100*b*, 100*c* may be attached to a common shaft 150. Each abrasive module 100*a*, 100*b*, 100*c* may be pressed against the surface SRF1 by an actuator 140*a*, 140*b*, 140*c*. Each actuator 140*a*, 140*b*, 140*c* may be attached to a common shaft 150. Each abrasive module 100*a*, 100*b*, 100*c* may be attached to the common shaft 150 via an actuator 140*a*, 140*b*, 140*c*.

The rotating actuator ROTA1 may be arranged to rotate the shaft 150. The shaft 150 may be rotated at an angular velocity ω1.

The positioning unit ZUNIT1 may be arranged to move the shaft 150 in the axial direction, e.g. in the direction SZ and/or in the direction −SZ. The shaft 150 may be moved at an axial velocity $v_{AX1}$.

Figure 4:
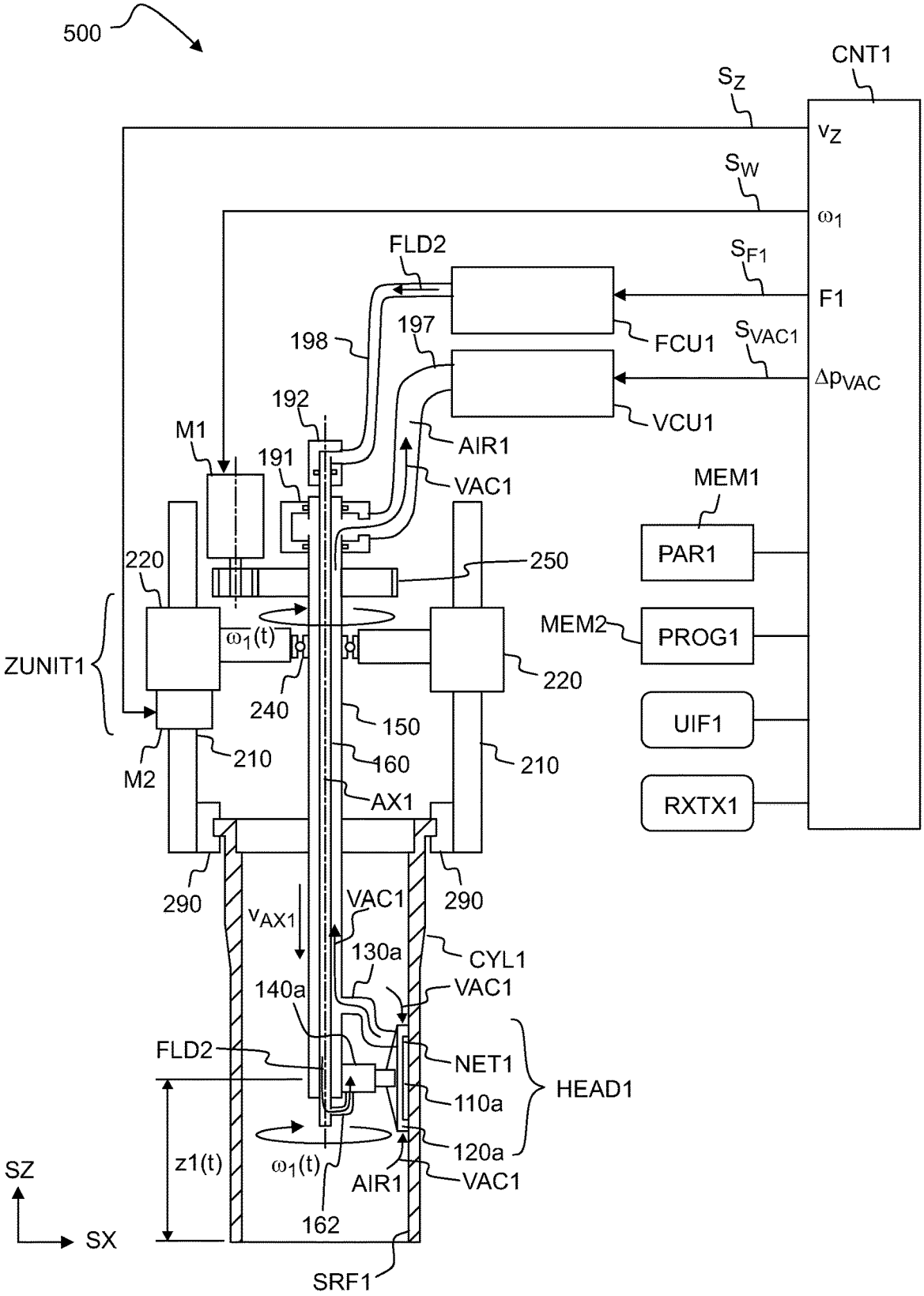
FIG. 4 shows, by way of example, in a cross-sectional side view, an apparatus for forming a groove pattern on the inner surface of a cylinder.

Forming of grooves G1, G2 by using abrasive grains AG1 of the abrasive mesh NET1 may release particles from the cylinder surface and/or from the abrasive mesh NET1. Some abrasive grains AG1 may be fractured and/or may become dull during forming the pattern PAT1. The patterning apparatus 500 may be arranged to remove the released particles by drawing AIR1 through the abrasive modules 100 to a dust suction apparatus VCU1 (FIG. 4). The dust suction apparatus VCU1 may cause an air flow VAC1.

The surface SRF1 may be substantially dry during forming the pattern PAT1. The pattern PAT1 may be formed without using a liquid between the abrasive mesh NET1 and the surface SRF1. In particular, the pattern PAT1 may be formed without using a honing oil. Using the abrasive modules on a dry surface SRF1 may facilitate removal of the loose particles by using the air flow. Using the abrasive modules with the dry surface SRF1 may allow forming the pattern PAT1 as a substantially dust free operation. The amount of dust falling to the bottom of the cylinder and/or to other parts of the engine may be minimized or eliminated. For example, the pattern PAT1 may be formed on a cylinder CYL1, which remains attached to an engine ICE1. Thanks to the dust free and oil free patterning method, the pattern PAT1 may be formed on the cylinder surface SRF1 even in a situation where the cylinder surface SRF1 is located above the installed crankshaft of the engine ICE1.

The air flow VAC1 may also cool the surface SRF1 and/or the abrasive grains AG1 of the abrasive mesh articles 110 during forming the grooves G1, G2.

A particle-laden air flow VAC1 may be guided from the abrasive modules 100*a*, 100*b*, 100*c* via ducts 130*a*, 130*b*, 130*c*. In particular, the ducts 130*a*, 130*b*, 130*c* may be flexible hoses.

The shaft 150 may be at least partly hollow, and the shaft may be used as a duct for guiding the particle-laden air flow VAC1 from the ducts 130*a*, 130*b*, 130*c* to a connection unit RCON1. The connection unit RCON1 may be attached to the shaft 150 via a rotating gas tight joint, which allows continuous rotation of the shaft 150 in a situation where the connection unit RCON1 does not rotate. The connection unit RCON1 may move together with the shaft 150 in the axial direction.

Figure 3A:
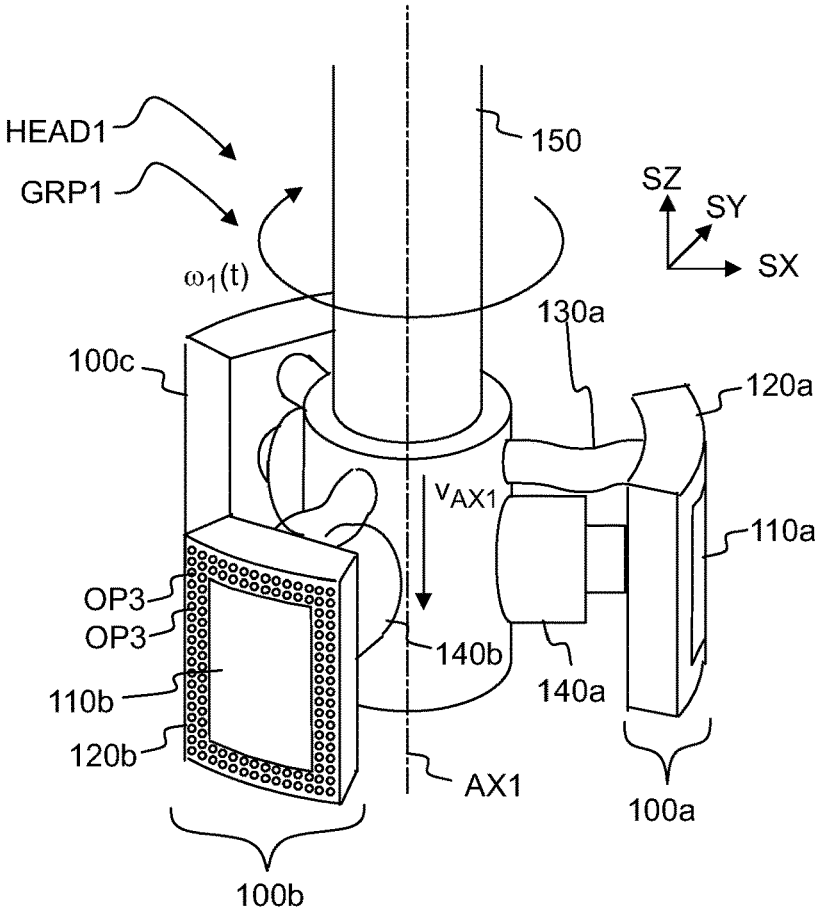
FIG. 3*a* shows, by way of example, in a three-dimensional view, a patterning head.
Figure 3B:
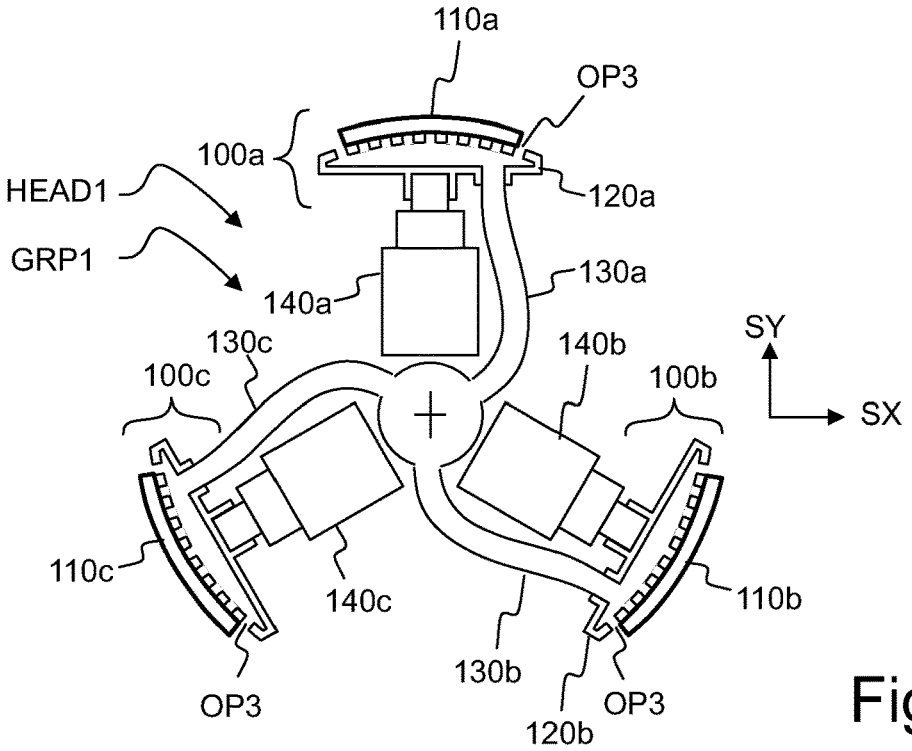
FIG. 3*b* shows, by way of example, in an axial view, a patterning head.

Referring to FIGS. 3*a* and 3*b*, the patterning head HEAD1 of the patterning apparatus 500 may comprise one or more abrasive modules 100*a*, 100*b*, 100*c*. The patterning head HEAD1 may comprise a group GRP1 of abrasive modules 100*a*, 100*b*, 100*c*.

Figure 3C:
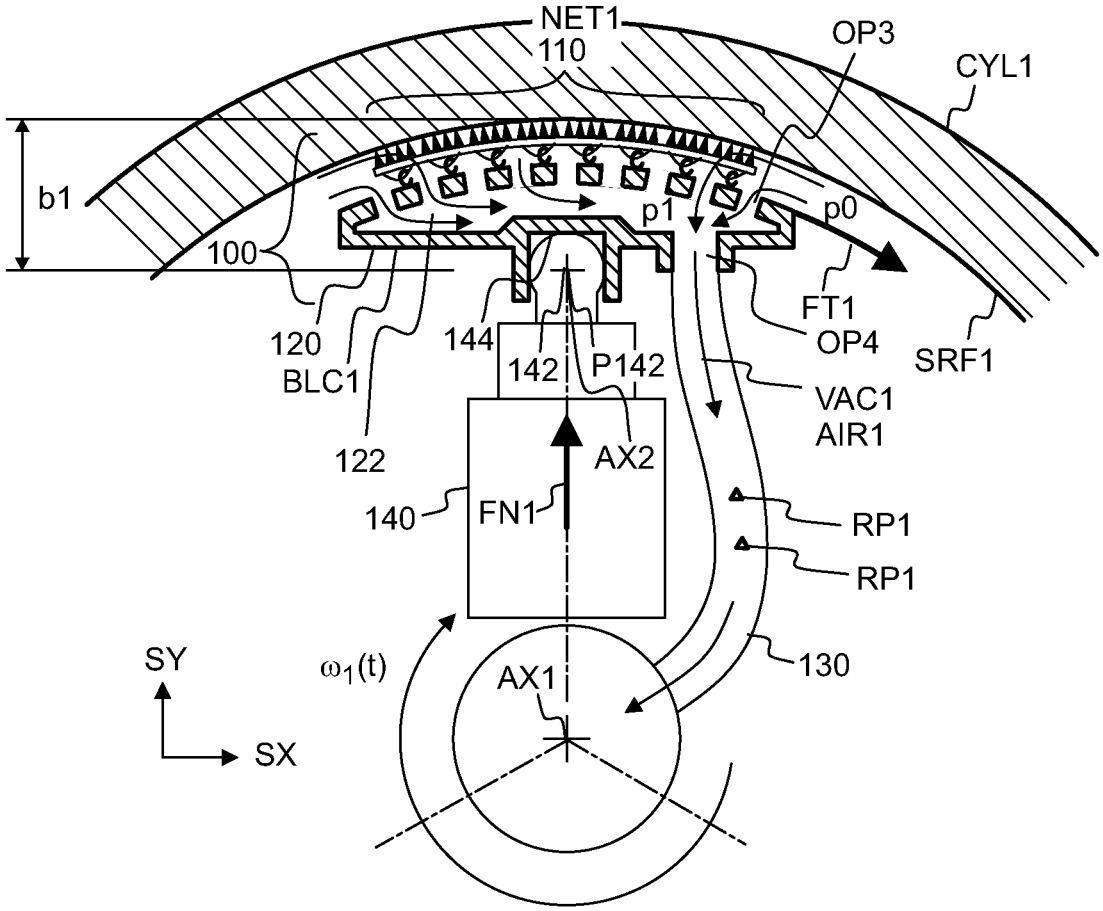
FIG. 3*c* shows, by way of example, in a cross-sectional axial view, processing the surface of a cylinder by using an abrasive module.

Referring to FIG. 3*c*, an abrasive module 100 may be pressed against the surface SRF1 of the cylinder CYL1 by an actuator 140. Particles RP1 may be released from the cylinder and/or from the abrasive article 110 during forming the grooves. The collector block BLC1 may comprise a plurality of openings OP3 for collecting the released particles RP1. Released particles RP1 may also be removed through miniature openings of the abrasive article 110. The apparatus may be arranged to draw an air flow VAC1 through miniature openings of the abrasive article 110 to the openings OP3 of the collector block BLC1, so as to collect released particles RP1.

The collector block BLC1 may comprise a collector chamber 122 for guiding partial air flows from the small inlet openings OP3 to a collector opening OP4. The partial air flows may be guided e.g. to a single collector opening OP4.

The air flow VAC1 may be guided from the collector opening OP4 to a dust suction apparatus e.g. via a duct 130. The duct 130 may be flexible in order to allow a change of radial position of the abrasive module 100, during operation of the actuator 140.

The actuator 140 may be e.g. a pneumatic actuator, an electromagnetic actuator and/or a hydraulic actuator. The abrasive module 100 may be pressed against the surface SRF1 with a pressing force FN1. The pressing force FN1 may be perpendicular to the surface SRF1. The actuator 140 may comprise a mechanical spring to provide the pressing force FN1. The actuator 140 may comprise a mechanical spring to provide a part of the pressing force FN1. The actuator may comprise e.g. a piece of elastic tubing, which is in contact with an end of a push rod. The tubing may expand when inflated by pressurized air so that the expanding tubing may push the rod towards an abrasive module with the pressing force FN1.

The abrasive module 100 may be moved by a transverse force FT1. The transverse force FT1 may cause a combined rotational and axial movement of the abrasive module 100 along the cylindrical surface SRF1. The transverse force FT1 may be generated by using a rotational actuator ROTA1 and/or by using a positioning unit ZUNIT1. The transverse force FT1 may be coupled to the abrasive module 100 e.g. via a shaft and via the actuator 140.

The abrasive module 100 may be connected to the actuator 140 by a joint 142. The tilting joint 142 may compensate small errors in the position of the actuator 140. The joint 142 may allow tilting of the block BLC1 with respect to the actuator 140 so that the entire area of the abrasive mesh article 110 may be firmly pressed against the cylinder surface SRF1 also in a situation where the axis of rotation of the patterning head HEAD1 would be slightly displaced with respect to the axis AX1 of the cylinder CYL1. The joint 142 may be a pivoting joint. The joint 142 may comprise e.g. one or more hinge links, a ball joint, and/or an elastic member. The joint 142 may comprise a quick release mechanism to facilitate replacement and/or removal of the module 100.

The joint 142 may allow tilting of the module 100 about at least one tilt axis. In particular, the joint 142 may allow tilting about a tilt axis AX2, which is substantially parallel with the axis AX1 of the cylinder CYL1. The tilt axis AX2 may be located at a point P142.

Using a small distance b1 between the joint 142 and the cylinder surface SRF1 may provide more uniform spatial distribution of forces to the abrasive grains of the module 100. Using a small distance b1 between the joint 142 and the cylinder surface SRF1 may provide more stable operation and/or may reduce vibrations.

The block BLC1 may optionally comprise a recessed portion 144. The joint 142 may be located in the recessed portion e.g. in order to reduce a distance b1 between the tilt axis AX2 and the cylinder surface SRF1.

Figure 3D:
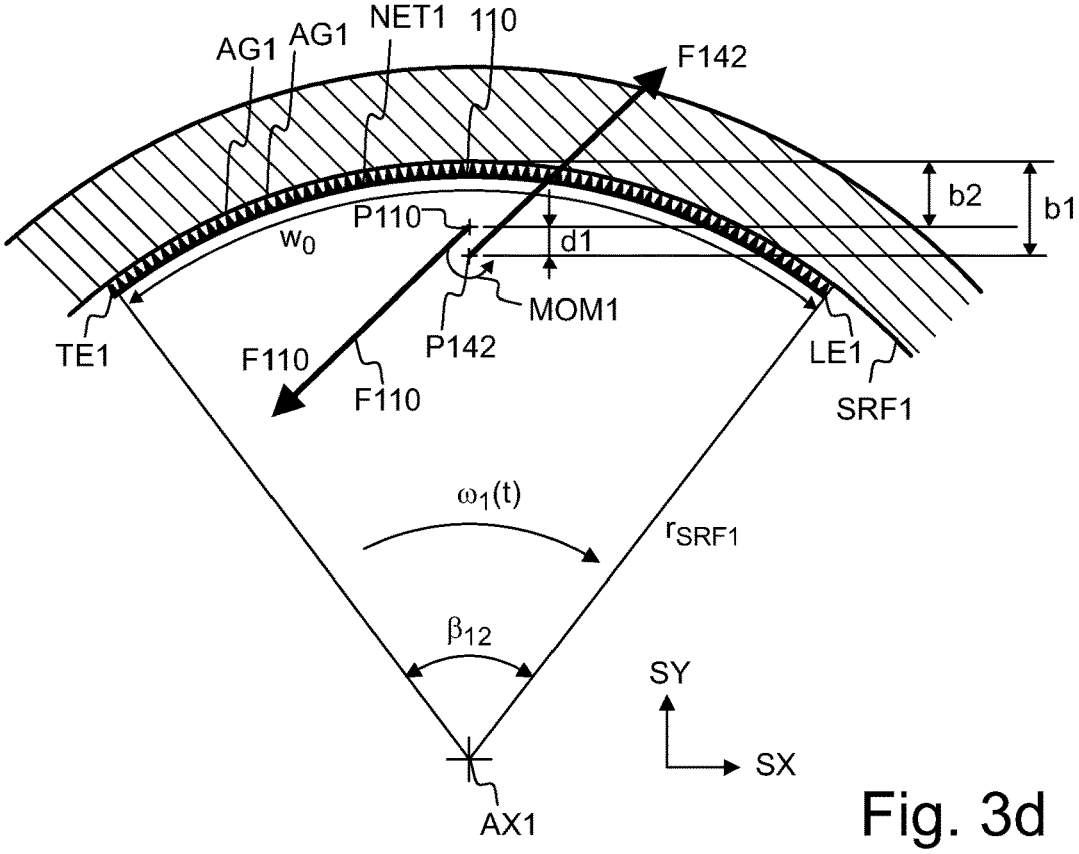
FIG. 3*d* shows, by way of example, in a cross-sectional axial view, forces exerted on an abrasive module in a situation where the abrasive module has a single abrasive mesh article.

FIG. 3*d* shows a situation where the abrasive module comprises a single abrasive article 110. The abrasive mesh NET1 may continuously extend from a leading edge LE1 of the module to a trailing edge TE2 of the module.

The apparatus 500 may exert a thrust force F142 to the abrasive module 100. The actuator 140 may exert the thrust force F142 to the block BLC1 via the joint 142, which may be located at the point P142. The thrust force F142 may comprise a pressing component FN1 and a transverse component FT1. The thrust force F142 may be formed as the sum of a normal component FN1, an axial component, and a tangential component. The normal component FN1 (i.e. the pressing force) may press the module 100 against the cylinder surface SRF1. The axial component of the force F142 may move the module 100 in the axial direction (+SZ and/or −SZ). The axial component of the force F142 may cause the rotation of the module about the cylinder axis AX1.

The cylinder surface SRF1 may resist the cutting movement of the abrasive grains AG1 by applying counter forces to the active abrasive grains AG1 of the article 110. The sum of said counter-forces may be represented by a resultant counter force F110, which is applied to a resultant point P110. To the first approximation, the position of the resultant point P110 may substantially coincide with the position of the weight of gravity of the abrasive article 110, in a situation where the pressure distribution would be uniform. The cross-section of the abrasive article 110 may be a circular arc when viewed in the direction of the axis AX1. To the first approximation, the position of the resultant point P110 may substantially coincide with the position of the weight of gravity of the circular arc defined by the leading edge LE1, by the trailing edge TE2, and the surface SRF1.

The difference between the angular position of the leading edge LE1 and the angular position of the trailing edge TE2 may correspond to an angular width or angular distance $\beta_{12}$ (angular width) when seen from the axis AX1.

The symbol $b_1$ denotes the distance between the joint 142 and the surface SRF1. $b_2$ denotes the distance between the resultant point P110 and the surface SRF1. d1 denotes the distance between the points P142 and P110. The resultant force F110 may cause a tilting moment MOM1 (i.e. torque), which is proportional to the distance d1. The tilting moment MOM1 may cause a nonuniform pressure distribution for the abrasive article. The nonuniform pressure distribution may shift the resultant point P110 until the tilting moment MOM1 becomes zero. The initial tilting moment MOM1 may cause that the leading edge of the abrasive article 110 is pressed against the cylinder surface SRF1 with a higher pressure than the trailing edge of the abrasive article 110. The uneven pressure distribution may cause a stability problem. The tilting moment may cause shifting of the resultant point and undesired vibration of the abrasive module 100 during operation. The stability of the abrasive module 100 may be improved e.g. by reducing the distance b1 and/or by increasing the distance b2.

The distance b1 may be reduced e.g. by positioning the joint 142 between the actuator 140 and the block BLC1 in a recess 144 (FIG. 3*c*).

The distance b2 may be increased e.g. by increasing the width $w_0$ of the abrasive article 110. The distance b2 may be increased by increasing the distance between the leading edge LE1 and the trailing edge TE2. The distance b2 may be increased by increasing the angular distance $\beta_{12}$ between the leading edge LE1 and the trailing edge TE2. The angular distance $\beta_{12}$ may be e.g. in the range of 15° to 110°. The angular distance $\beta_{12}$ may be e.g. greater than 15° to provide sufficient stability. The angular distance $\beta_{12}$ may be e.g. greater than 30° to provide high stability. The angular distance $\beta_{12}$ may be e.g. greater than 60° to provide very high stability.

In case of a single abrasive article 110, the angular distance $\beta_{12}$ may be calculated e.g. by the formula $(180°/\pi)\cdot(w_0/r_{SRF1})$, where $w_0$ denotes the width of the article 110, and $r_{SRF1}$ is the radius of the cylinder. The leading edge, the trailing edge TE2, and the surface SRF1 may define an arc, which has a length $w_0$.

Figure 3E:
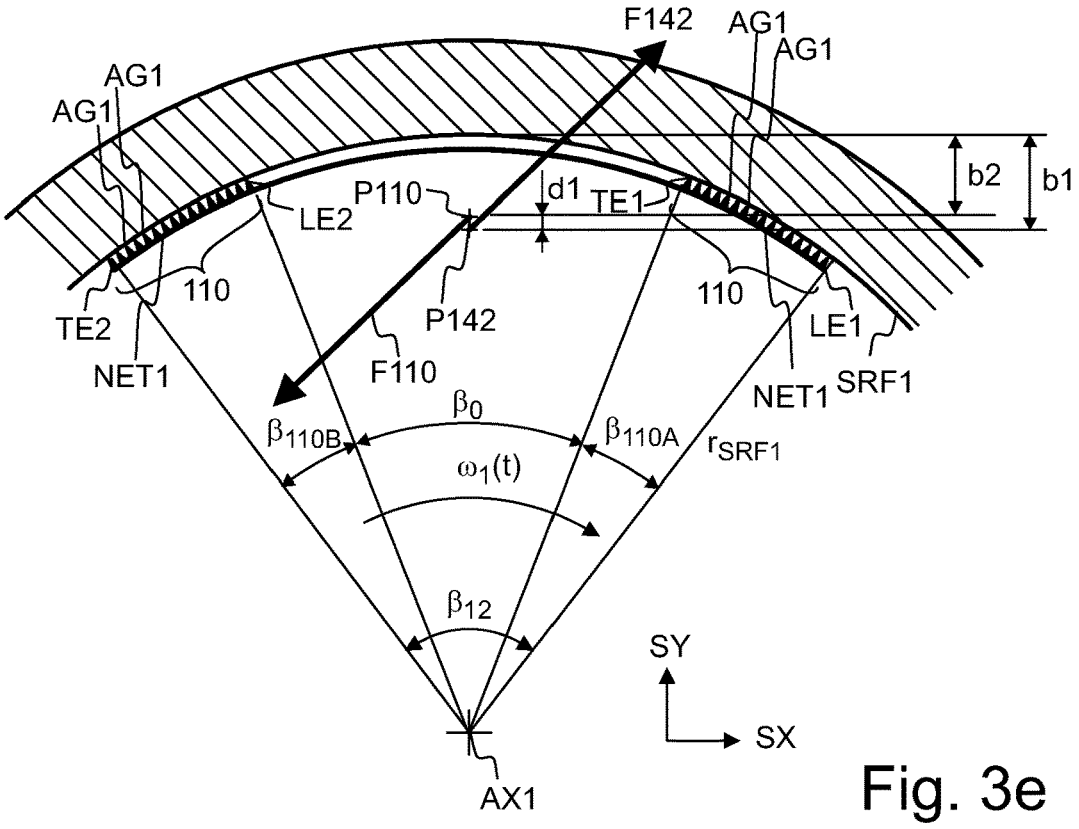
FIG. 3*e* shows, by way of example, in a cross-sectional axial view, an forces exerted on an abrasive module in a situation where the abrasive module has two abrasive mesh articles.

Referring to FIG. 3*e*, the distance b2 may also be increased e.g. by attaching two abrasive articles 110 to the same block BLC1. A first abrasive article 110 may have a leading edge LE1 and a trailing edge TE1. A second abrasive article 110 may have a leading edge LE2 and a trailing edge TE2. $\beta_{110A}$ denotes angular distance between the leading edge LE1 and the trailing edge TE1. The trailing edge TE1 may be separated from the leading edge LE2 by a gap. $\beta_0$ denotes angular distance between the trailing edge TE1 and the leading edge LE2. $\beta_{110B}$ denotes angular distance between the leading edge LE2 and the trailing edge TE2. When using several abrasive articles 110, the angular distance $\beta_{12}$ may be e.g. in the range of 15° to 110°.

Improved stability may also be provided e.g. by using an abrasive article 110, which has a central opening. The angular width ($\beta_0$) of the central opening may be e.g. in the range of 50% to 90% of the angular distance $\beta_{12}$.

Referring to FIG. 4, The patterning apparatus 500 may be temporarily attached to the cylinder CYL1. The positioning unit ZUNIT1 may be attached to the cylinder CYL1 e.g. by one or more clamps 290, by one or more screw joints and/or by one or more magnets.

The apparatus 500 may comprise a bearing 240 for defining the axial position of the shaft 150. The rotating shaft 150 may be attached to the non-rotating positioning unit ZUNIT1 via the bearing 240. The bearing 240 may transmit axial force from the positioning unit ZUNIT1 to the shaft 150.

The apparatus 500 may comprise a control unit CNT1 for controlling operation of the apparatus 500.

The apparatus 500 may comprise a memory MEM1 for storing operating parameters PAR1. The operating parameters PAR1 may specify e.g. one or more of the following:

angular velocity ω1,
axial velocity $v_{AX1}$,
ratio of the axial velocity $v_{AX1}$ to the angular velocity ω1,
axial start position z,
length of axial stroke h1,
number of axial strokes,
pressing force FN1.

The control unit CNT1 may be arranged to provide a control signal $S_Z$ for controlling operation of the (linear) positioning unit ZUNIT1, M2.

The control unit CNT1 may be arranged to provide a control signal $S_W$ for controlling operation of the rotating actuator ROTA1, M1.

The control unit CNT1 may be arranged to provide a control signal $S_{F1}$ for controlling the pressing force FN1 generated by the one or more actuators 140*a*, 140*b*, 140*c*.

The control unit CNT1 may be arranged to provide a control signal $S_{VAC1}$ for controlling the rate of the air flow VAC1 and/or for controlling the pressure difference $\Delta p_{VAC}$ ($=p_0-p_1$). $p_0$ may denote the ambient pressure (typically approximately 100 kPa), and $p_1$ may denote the pressure inside the collector block BLC1.

The apparatus 500 may comprise a memory MEM2 for storing computer program code PROG1. The control unit CNT1 may comprise one or more data processors. The control unit CNT1 may be configured to perform method steps according to the program code PROG1. The control unit CNT1 may be configured to cause the apparatus 500 to form a groove pattern PAT1 according to the program code PROG1.

The apparatus 500 may comprise a user interface UIF1 for receiving user input from a (human) user and/or for providing information to a (human) user. The user interface UIF1 may comprise e.g. a display and/or a keypad. The user interface UIF1 may comprise e.g. a touch screen.

The apparatus 500 may comprise a communication unit RXTX1 for receiving and/or transmitting data. The apparatus 500 may e.g. receive data from a process automation system and/or the apparatus 500 may transmit data to the process automation system by using the communication unit RXTX1.

The apparatus 500 may e.g. receive a start command, in order to synchronize forming the groove pattern with the operation of a process automation system. The apparatus 500 may be used e.g. for mass production of a plurality of cylinders CYL1.

The apparatus 500 may e.g. receive operating parameters PAR1 via the communication unit RXTX1.

The communication unit RXTX1 may also receive data from a server and/or from a user device via the Internet. The communication unit RXTX1 may transmit data to a server and/or to a user device via the Internet. The communication unit RXTX1 may be arranged to communicate e.g. via an electric cable, via an optical cable, via a wireless local area network, via a mobile communications network (e.g. 3G, 4G, 5G), and/or via Bluetooth.

The apparatus 500 may comprise a dust suction unit VCU1 for drawing the particle-laden gas stream VAC1 from the abrasive modules 100*a*, 100*b*, 100*c*. The dust suction unit VCU1 may be e.g. vacuum cleaner. The dust suction unit VCU1 may be controlled according to a vacuum control signal $S_{VAC1}$ received from the control unit CNT1. The air flow rate and/or a pressure difference $p_0-p_1$ may be controlled according to the vacuum control signal $S_{VAC1}$. The dust suction unit VCU1 may be e.g. switched on and off according to the vacuum control signal $S_{VAC1}$.

The dust suction unit VCU1 may be connected to the connection unit RCON1 via a duct 197. The duct 197 may be e.g. a flexible hose. The rotating shaft 150 may be connected to a fitting 191 via a rotating joint. The connection unit RCON1 may comprise the fitting 191 and/or the fitting 192.

The apparatus 500 may comprise a driver unit FCU1 for driving the actuators 140*a*, 140*b*, 140*c*. The driver unit FCU1 may comprise e.g. a solenoid valve for controlling pressure of a pneumatic or hydraulic actuator, according to a force control signal $S_{F1}$ received from the control unit CNT1. The driver unit FCU1 may be connected to the actuators 140*a*, 140*b*, 140*c* e.g. via a duct 198, via a fitting 192, and via ducts 160, 162. The rotating duct 160 may be connected to the fitting 192 via a rotating joint. The driver unit FCU1 may drive the actuators 140*a*, 140*b*, 140*c* e.g. by using a fluid FLD2. The fluid FLD2 may be e.g. compressed air or a hydraulic fluid. In case of electromagnetic actuators 140*a*, 140*b*, 140*c*, the driver unit FCU1 may comprise e.g. an electric circuit for generating an electric current according to a control signal $S_{F1}$ received from the control unit CNT1. An electromagnetic actuator 140*a*, 140*b*, 140*c* may generate a force FN1, which is substantially proportional to the electric current.

In an embodiment, the cylinder CYL1 may be held stationary, and the abrasive modules 100*a*, 100*b*, 100*c* may be moved.

In an embodiment, the abrasive modules 100*a*, 100*b*, 100*c* may be held stationary, and the cylinder CYL1 may be moved.

In an embodiment, the cylinder CYL1 may be rotated (e.g. in a lathe), and the abrasive modules 100*a*, 100*b*, 100*c* may be moved in the axial direction inside the cylinder CYL1.

In an embodiment, the patterning head may be rotated, and the cylinder CYL1 may be moved in the axial direction.

Figure 5A:
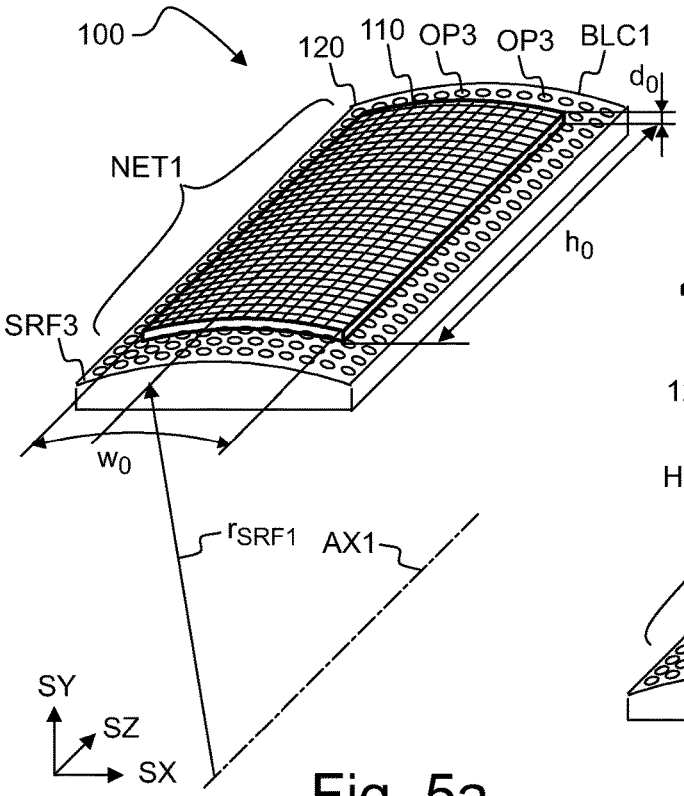
FIG. 5*a* shows, by way of example, in a three-dimensional view, an abrasive module comprising an abrasive mesh article attached to a collector block.

Referring to FIG. 5*a*, an abrasive module 100 may comprise a piece 110 of abrasive mesh NET1 attached to a curved supporting surface SRF3 of a collector unit 120. The supporting surface SRF3 may comprise a plurality of openings OP3 for collecting released particles, which are drawn through the abrasive mesh NET1. The abrasive mesh NET1 may comprise a plurality of first openings OP1 for drawing air AIR1 and released particles RP1 to the curved surface SRF3 of the collector block BLC1. The collector block BLC1 may comprise a plurality of second openings OP3 for drawing air AIR1 and released particles RP1 into the collector block BLC1 through the openings OP3 the curved surface SRF3.

The piece 110 may have a width $w_0$ and a height $h_0$. The piece 110 may be called e.g. as an abrasive mesh article 110. The ratio of the height $h_0$ to the width $w_0$ may be e.g. in the range of 0.05 to 20, advantageously in the range of 0.2 to 5.

Figure 5B:
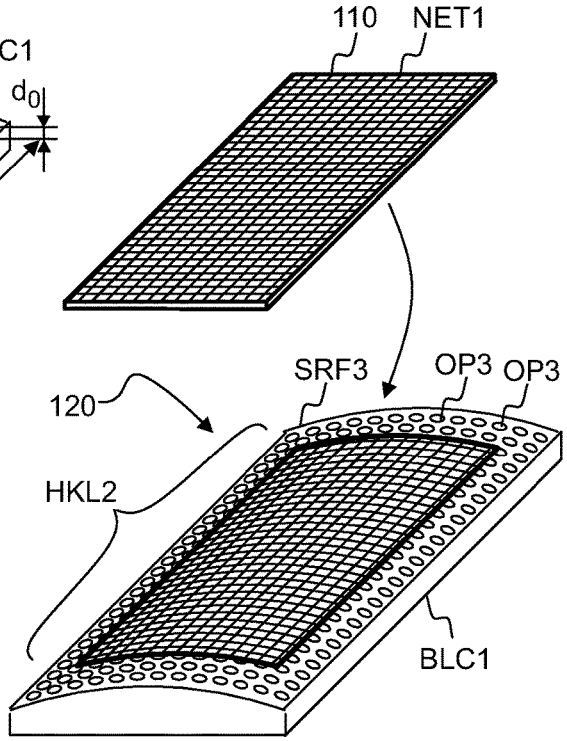
FIG. 5*b* shows, by way of example, attaching the abrasive mesh article to the collector block.

Referring to FIG. 5*b*, the abrasive mesh article 100 may be releasably attached to the collector unit 120 e.g. by a hook and loop fastening system HLSYS1. The collector unit 120 may comprise a collector block BLC1 and a layer HKL2 of miniature hooks fastened to the collector block BLC1. The article 110 may be releasably attached to the collector block BLC1. The article 110 may be attached to the collector block BLC1 by the hook and loop fastening system HLSYS1. An example of the hook and loop fastening system HLSYS1 is shown e.g. in FIG. 6*b*.

Figure 5C:
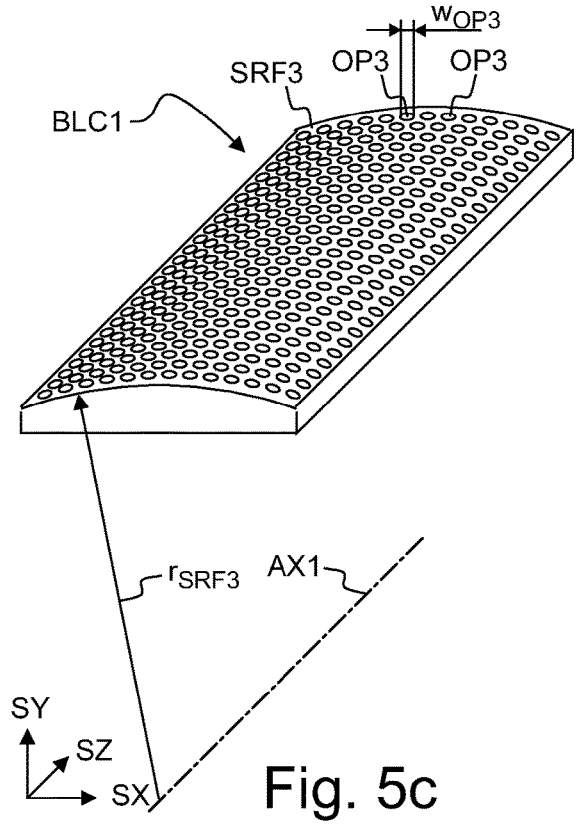
FIG. 5*c* shows, by way of example, in a three-dimensional view, the collector block.

Referring to FIG. 5*c*, the collector block BLC1 may have a curved supporting surface SRF3. The supporting surface SRF3 may comprise a plurality of openings OP3 for the air flow VAC1. The curved supporting surface SRF3 may be a portion of a cylindrical surface. The surface SRF3 may have a radius of curvature $r_{SRF3}$. The block BLC1 may also be called e.g. as a supporting block BLC1.

The combination of the abrasive mesh NET1 and the hook and loop fastening system HLSYS1 may have a certain thickness $d_0$ when pressed against the surface SRF1 of the cylinder CYL1. The radius of curvature $r_{SRF3}$ of the supporting surface SRF3 may be selected according to the radius $r_{SRF1}$ of the cylinder CYL1 such that the effective radius of curvature of the abrasive layer of the article 110 may substantially correspond to the radius of the $r_{SRF1}$ of the cylinder CYL1.

The air inlet openings OP3 may be e.g. circular, elliptical, or rectangular. One or more openings OP3 may be narrow slits. The width $w_{OP3}$ of one or more openings may be e.g. in the range of 0.2 mm to 5.0 mm, advantageously in the range of 0.5 to 3.0 mm. If the openings OP3 are too narrow, then they may be blocked by released particles. If the openings are too large, they do not provide sufficient support for the abrasive mesh. The openings OP3 may also be arranged to distribute the flow rates of the partial air flows of the different openings OP3 so as to ensure efficient removal of the particles. The dimensions of the openings OP3 may be selected such that sufficient air flow is ensured for all openings OP3 needed for removing the particles.

The collector clock BLC1 may be produced e.g. by 3D printing, according to the diameter of the cylinder. The collector clock BLC1 may also be assembled from a plurality of parts. The collector clock BLC1 may also be produced e.g. by machining and/or casting.

The collector clock BLC1 may be rigid. The dimensions of the collector clock BLC1 may be selected such that the geometric shape of the surface SRF3 is not significantly deformed when the module 100 is pressed against the cylinder surface SRF1 with the pressing force FN1. As shown in FIG. 3*c*, the collector clock BLC1 may be comprise an air collection chamber 122. The hollow collector clock BLC1 may comprise internal columns and/or stiffeners to increase the stiffness of the collector clock BLC1.

Figure 5D:
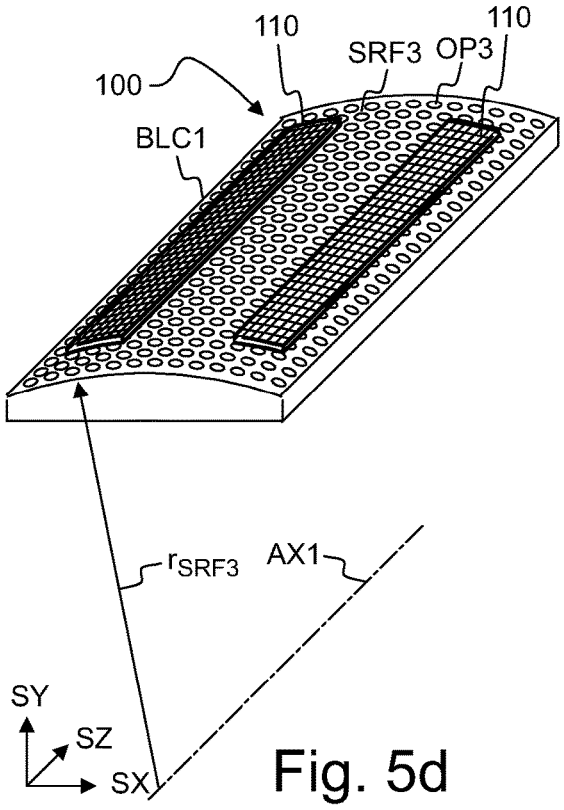
FIG. 5*d* shows, by way of example, in a three-dimensional view, an abrasive module, which comprises two abrasive mesh articles attached to the same collector block.

Referring to FIG. 5*d*, two or more abrasive mesh articles 110 may be attached to the same collector block BLC. The abrasive mesh articles 110 may be strips. The abrasive mesh strips 110 may be e.g. substantially parallel with the axis AX1 of the cylinder. For example, the patterning head HEAD1 may comprise three abrasive modules 100, and each abrasive module 100 may comprise two abrasive mesh strips 110.

The difference between angular positions of adjacent abrasive mesh strips 110 may be e.g. substantially equal to 60°, so as to provide substantially even angular distribution of the (six) abrasive mesh strips 110 over the 360° circumference. Attaching two or more strips 110 to the same block BLC may facilitate processing the cylinder surface SRF1 in a spatially uniform manner, when using a limited number of axial strokes. Attaching two or more strips 110 to the same block BLC may improve stability.

The longitudinal direction of the abrasive mesh strips 110 may also be e.g. substantially perpendicular to the axis AX1 of the cylinder. The longitudinal direction of the abrasive mesh strips 110 may also be inclined with respect to to the axis AX1 of the cylinder. Two or more abrasive mesh articles 110 may be attached to the same collector unit 120.

The article 110 does not need to be continuous rectangular piece. For example, the article 110 may have one or more large openings in the middle. The sides of the article 110 may be parallel with the axis AX1 or inclined with respect to the axis AX1.

Figure 6A:
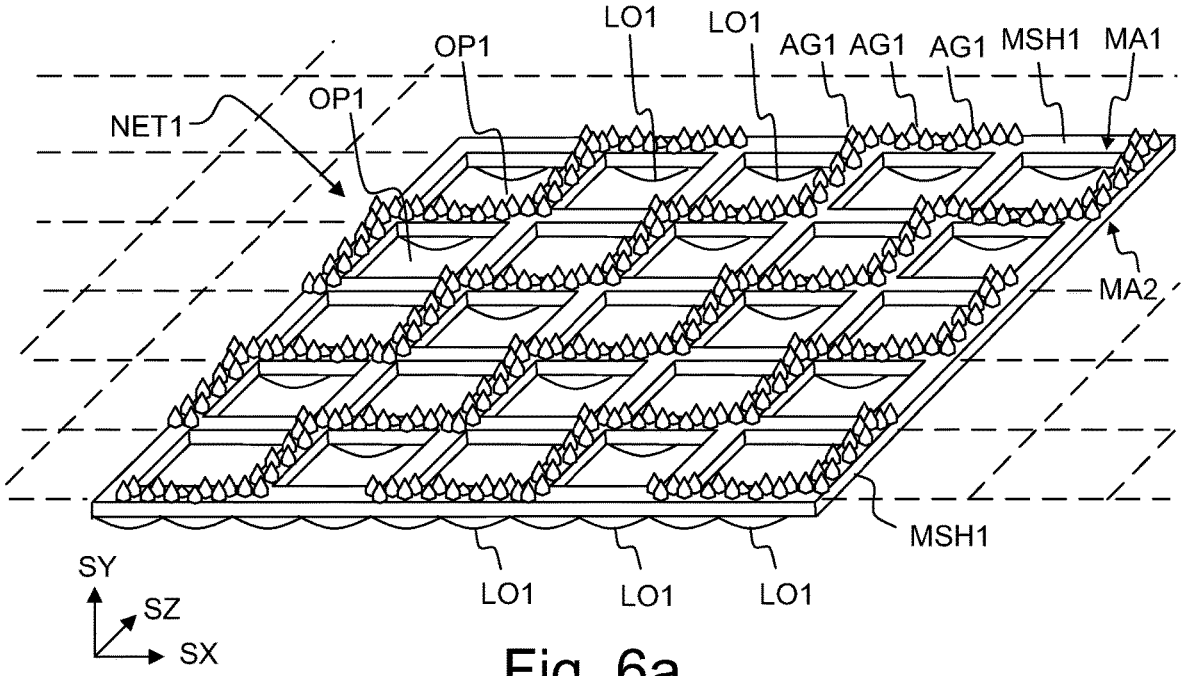
FIG. 6*a* shows, by way of example, in a three-dimensional view, an abrasive mesh.
Figure 6B:
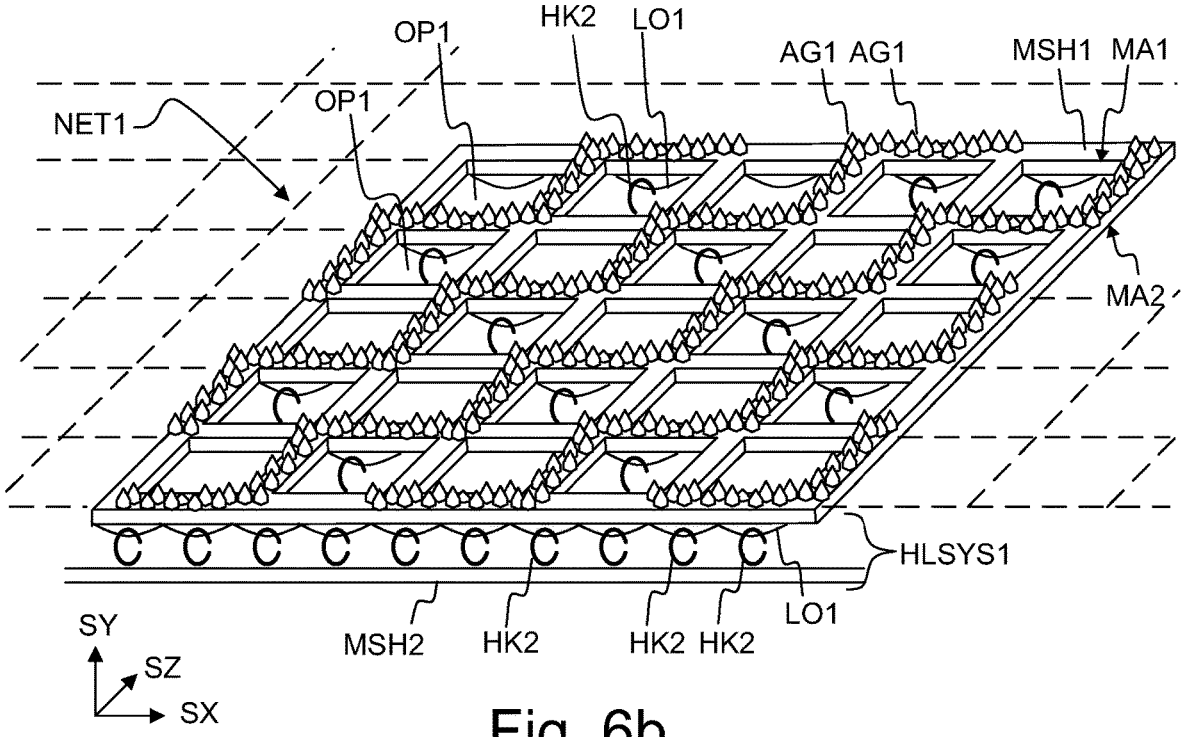
FIG. 6*b* shows, by way of example, in a three-dimensional view, an abrasive mesh fastened by a hook and loop fastening system.
Figure 6C:
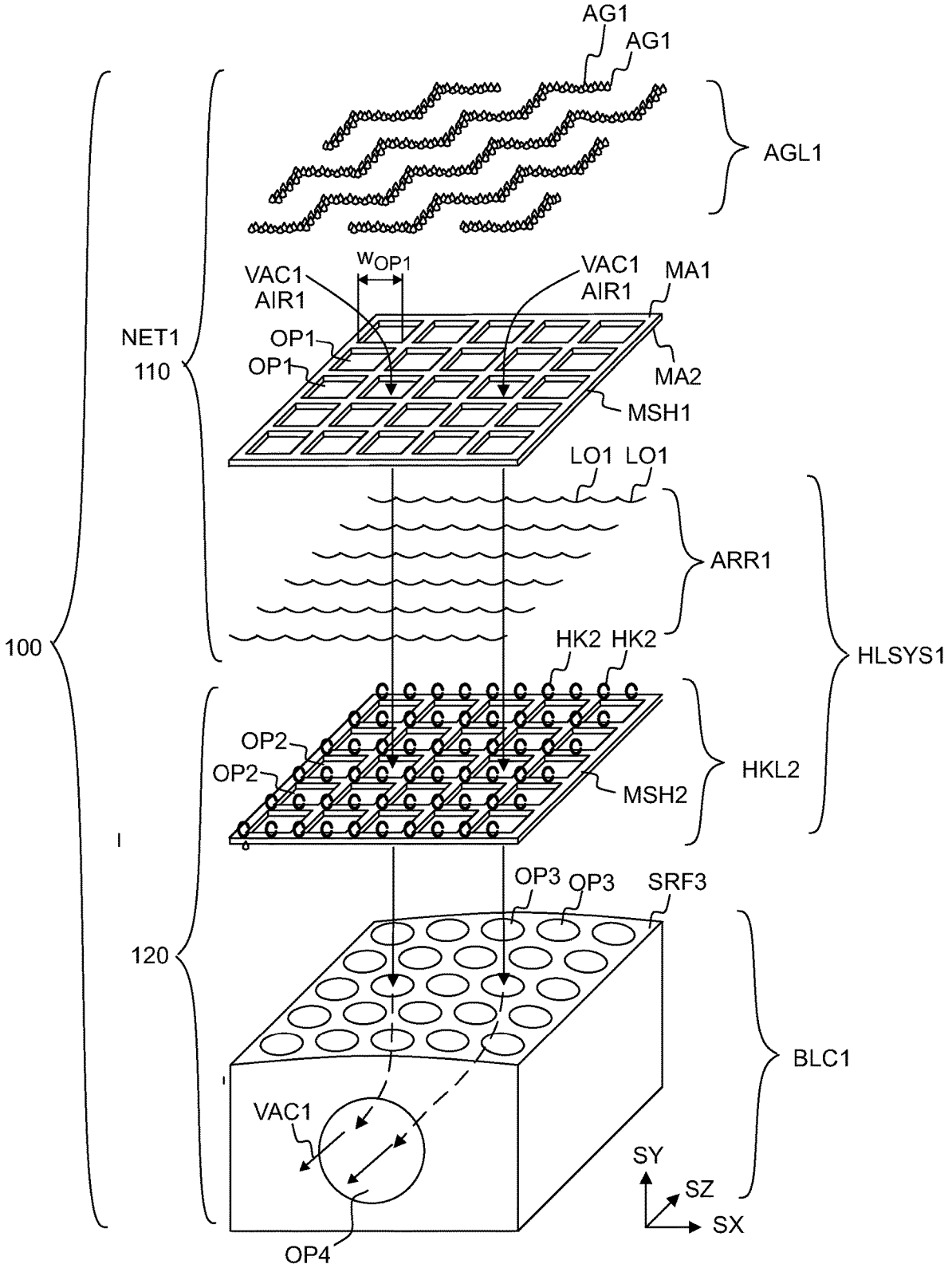
FIG. 6*c* shows, by way of example, in a three-dimensional exploded view, structural layers of an abrasive module, which comprises an abrasive mesh supported on a collector block.

Referring to FIGS. 6*a* to 6*c*, the abrasive mesh NET1 may comprise a plurality of abrasive grains AG1 attached to an open mesh backing MSH1. The open mesh backing MSH1 may have a first major surface MA1, a second major surface MA2, and a plurality of openings OP1 extending from said first major surface to said second major surface. The abrasive mesh NET1 may comprise a layer of abrasive grains AG1 secured to at least a portion of said first major surface of said backing MSH1. The abrasive layer may comprise a plurality of erectly oriented abrasive grains AG1. The abrasive grains AG1 may be bonded to the mesh backing MSH1 e.g. by at least one binder ADH1 (the binder is shown e.g. in FIG. 14*a*).

The abrasive grains may comprise or consist essentially of e.g. silicon carbide (SiC), aluminum oxide ($Al_2O_3$), synthetic diamond, natural diamond, and/or boron carbide. In particular, silicon carbide may be used for forming grooves G1, G2 in cast iron. The abrasive grains may be ceramic abrasive grains and/or engineered abrasive grains.

The abrasive grains AG1 of the abrasive mesh NET1 may have a controlled orientation. The abrasive grains AG1 may be erect, i.e. the longitudinal axis of the abrasive grains AG1 may be substantially perpendicular to the first major surface of the backing MSH1 of the abrasive mesh NET1. The orientation of the abrasive grains AG1 may be controlled during production of the abrasive mesh NET1 e.g. by using an electric field. Consequently, the abrasive mesh NET1 may comprise a plurality of abrasive grains AG1, which are capable of cutting deep grooves G1, G2 in the surface SRF1. The height of the abrasive grains AG1 may be greater than the depth $d_{G1}$ of the formed groove G1. The average value of the depth to width ratio $d_{G1}/w_{G1}$ of the grooves G1 may be high (the depth $d_{G1}$ and the width $w_{G1}$ are shown in FIG. 14*e*).

The abrasive grains AG1 of the abrasive mesh NET1 may be optionally selected to have a narrow size distribution, e.g. in order to ensure spatially uniform processing of the cylinder surface. The narrow size distribution may be provided from a standard distribution e.g. by sieving, elutriation, sedimentation and/or cyclone separation.

The abrasive mesh NET1 may comprise a plurality of holes OP1. The size of the holes OP1 may be selected such that particles EP1 released from the cylinder surface SRF1 may pass through the openings OP1. The size of the openings OP1 may be selected such that the abrasive grains AG1, if detached from the backing MSH1, may easily pass through the openings OP1. The width $w_{OP1}$ of the openings OP1 may be e.g. in the range of 0.1 mm to 2 mm. The number density of the openings OP1 of the abrasive mesh NET1 may be e.g. in the range of 10 holes (OP1) per $cm^2$ to 2000 holes (OP1) per $cm^2$. A square centimeter (1 cm×1 cm) of the abrasive mesh NET1 may comprise at least 10 openings OP1.

The openings OP1 may have a total open area, which may be e.g. greater than or equal to 30% of the area of the first major surface, advantageously greater than or equal to 50% of the area of the first major surface. The area of the first major surface means the one-sided area defined by the perimeter of the mesh backing MSH1.

The mesh backing MSH1 may comprise a mesh structure formed of interconnected mesh elements. The mesh backing may comprise e.g. polymer, fiberglass and/or metal. The metal may be e.g. aluminum, brass, copper or steel. The polymer may be e.g. nylon, polyester, or polypropylene. The mesh backing may be e.g. a perforated film. The mesh backing may comprise e.g. a mesh formed of wires. The mesh backing may be formed from wires e.g. by weaving or knitting. Wires may be connected to each other at connecting nodes of the mesh e.g. by welding, soldering and/or by using an adhesive.

The abrasive grains AG1 of the abrasive mesh NET1 may have a certain size distribution. The grooves may be formed mainly by the tallest peaks of the abrasive grains. The abrasive mesh NET1 may be produced such that the abrasive grains AG1 of the abrasive mesh NET1 have a narrow size distribution. Consequently, a large part of the abrasive grains AG1 of the abrasive mesh NET1 may participate in forming deep grooves.

The pressing force generated by the actuator 140 is distributed among the peaks of the abrasive grains AG1 of the abrasive mesh NET1. If the number density of the abrasive grains AG1 is too large, then a high pressing force FN1 needs to be generated in order to form deep grooves. For producing the grooves G1, G2, the number density of abrasive grains AG1 of the abrasive mesh NET1 may be e.g. in the range of 1 grain/$mm^2$ to 40 grains/$mm^2$ (1 $mm^2=10^{-6}$ $m^2$). The abrasive mesh NET1 may comprise a single monolayer of abrasive grains AG1 such that the peaks of the abrasive grains may define a substantially planar or a substantially cylindrical surface. An abrasive article may sometimes comprise a rider grain, i.e. an abrasive grain which significantly protrudes with respect to the other grains. The abrasive mesh NET1 may comprise a single monolayer of abrasive grains AG1 in order to avoid the rider grains, or in order to reduce the number of the rider grains.

For producing the grooves G1, G2, the grit size of the abrasive grains AG1 of the abrasive mesh NET1 may be e.g. in the range of 60 to 120 (FEPA P), advantageously substantially equal to 80. The grit size may be determined according to the standard FEPA 43-1:2006. The abrasive grains AG1 of the abrasive mesh NET1 may correspond e.g. to a grit size, which has been selected from the range of 60 to 120 (FEPA P), i.e. the average size of the grains may be e.g. in the range of 125 μm to 270 μm. The grit size may be e.g. 60, 80, 100, or 120. For example, grit size 80 (FEPA P) may approximately correspond to an average grain size of 200 μm.

The thickness of the mesh backing MSH1 may be e.g. in the range of 0.1 mm to 3 mm. The abrasive mesh NET1 may be flexible. The minimum bending radius of the abrasive mesh NET1 may be e.g. smaller than 20 mm, without causing irreversible deformation of the mesh backing MSH1

The abrasive mesh NET1 may comprise a plurality of loops LO1 so that the abrasive mesh NET1 may be removably attached to the block BLC1 by a hook and loop fastening system HLSYS1. The loops LO1 may be permanently fastened to the mesh backing MSH1. The loops LO1 may be associated with the second major surface MA2 of the open mesh backing MSH1.

Referring to FIG. 6*b*, the hook and loop fastening system HLSYS1 may comprise a plurality of hooks HK2, which may be removably attached to the loops LO1 of the abrasive mesh NET1. The hooks HK2 may be permanently fastened to an auxiliary mesh structure MSH2. The auxiliary mesh structure MSH2 may be attached to an underlying supporting block BLC1 e.g. by an adhesive.

The hook and loop fastening system HLSYS1 may provide e.g. one or more of the following effects:

- the abrasive mesh NET1 may be easily fastened to the block BLC1 and/or may be easily removed from the block BLC1,
- a first abrasive mesh NET1 comprising worn and/or dull abrasive grains AG1 may be easily replaced with a second abrasive mesh NET1, which has intact abrasive grains AG1,
- the size of the abrasive grains AG1 may be easily changed, by replacing a first abrasive mesh NET1 with a second abrasive mesh NET1,
- removed particles may easily pass through the hook and loop fastening system,
- the hook and loop fastening may provide resilient support for the abrasive mesh NET1, in a direction (e.g. in the direction SY) which is perpendicular to the surface SRF1 of the cylinder CYL1,
- the hook and loop fastening may effectively transfer a transverse force from the block BLC to the abrasive mesh NET1,
- the hook and loop fastening may allow transverse movement of air and released particles in an intermediate space defined by a collecting block and the abrasive mesh NET1.

The height of the hooks HK2 may be e.g. in the range of 0.5 mm to 3 mm. The hooks HK2 may e.g. comprise or consist of a polymer. The hooks HK2 may comprise or consist of polyester, polyamide, or polyvinyl. The hooks HK2 may comprise or consist of metal. The hooks HK2 may be produced e.g. by cutting closed loops such that the loops become open. The hooks HK2 may also be produced e.g. casting, or 3D printing. The hooks HK2 may also be e.g. mushroom-type hooks.

FIG. 6*c* shows, in an exploded view, structural layers of the abrasive module 100. The abrasive module 100 may comprise a piece 110 of abrasive mesh NET1 and a collector unit 120. The abrasive piece 110 may be removably attached to the collector unit 120 by a hook and loop fastening system HLSYS1.

The abrasive mesh NET1 may comprise a backing mesh MSH1, a plurality of abrasive grains AG1 bonded to the backing mesh MSH1, and a layer ARR1 of fastening loops LO1. The abrasive mesh NET1 may comprise a layer AGL1 of abrasive grains AG1. The abrasive grains AG1 may be bonded to the backing mesh MSH1 e.g. by an adhesive. The abrasive mesh NET1 may comprise a plurality of loops LO1 firmly connected to the backing mesh MSH1. The loops LO1 may together form a layer ARR1 of loops LO1.

The collector unit 120 may comprise a collector block BLC1 and a layer HKL2 of fastening hooks HK2. The fastening hooks HK2 may be permanently fastened to an auxiliary mesh MSH2. The auxiliary mesh MSH2 may be attached to a curved surface SRF3 of the collector block BLC1 e.g. by an adhesive.

The method may comprise collecting released particles RP1 by an air flow VAC1. An air flow VAC1 may be drawn through the abrasive net NET1, through the fastening system HLSYS1, and through the collector block BLC1 to a dust suction apparatus.

The mesh backing MSH1 may comprise a plurality of openings OP1. The auxiliary mesh MSH2 may comprise a plurality of openings OP2. The collector block BLC1 may comprise a plurality openings OP3. The abrasive module 100 may be arranged to operate such that released abrasive grains AG1 may pass through the openings OP1, OP2, OP3 into the collector block BLC1. The openings OP1 of the abrasive mesh NET1 may be in communication with the openings OP3 of the block BLC1 via the releasable fastening system HLSYS1, such that air flow VAC1 may carry released particles through the openings OP1 to the openings OP3 via the releasable fastening system HLSYS1. The openings OP1 of the abrasive mesh NET1 may be in fluid communication with the openings OP3 of the block BLC1 via the releasable fastening system HLSYS1.

The fastening system HLSYS1 may allow movement of air AIR1 and released particles RP1 in the radial direction, i.e. in the direction, which is substantially perpendicular to the supporting surface SRF3. The fastening system HLSYS1 may also allow movement of air AIR1 and released particles RP1 in a transverse direction, i.e. in a direction, which is substantially parallel with the supporting surface SRF3.

The first openings OP1 may be in communication with the second openings OP3 via the hook and loop fastening system HLSYS1, for providing access for the particles RP1 from the first openings OP1 to the second openings OP3 via the hook and loop fastening system HLSYS1. The first openings OP1 may be in communication with the second openings OP3 via the hook and loop fastening system HLSYS1, for providing pathways for the particles RP1 from the first openings OP1 to the second openings OP3 via the hook and loop fastening system HLSYS1. The first openings OP1 may be in communication with the second openings OP3, such that the air flow VAC1 may carry the released particles RP1 through the first openings OP1 to the second openings OP3 via the hook and loop fastening system HLSYS1. The hook and loop fastening system HLSYS1 may operate as a permeable spacer layer, which may provide multiple pathways for the particles RP1 from the first openings OP1 to the second openings OP3 via the hook and loop fastening system HLSYS1.

In particular, the hook and loop fastening system HLSYS1 may allow transverse movement of air AIR1 and released particles RP1 in the space defined between the backing MSH1 and the collector block BLC1. Consequently, the abrasive module 100 may effectively remove released particles RP1 also in a situation where the openings OP1 of the backing MSH1 are displaced in the transverse direction (e.g. in the axial direction SZ and/or in the direction of the tangent of the cylinder) with respect to the openings OP3 of the block BLC1. A released particle RP1 may be drawn through one of the openings OP1, may move in a transverse direction in the space defined between the backing MSH1 and the collector block BLC1, and may be drawn into the block BLC through one of the openings OP3.

Figure 7A:
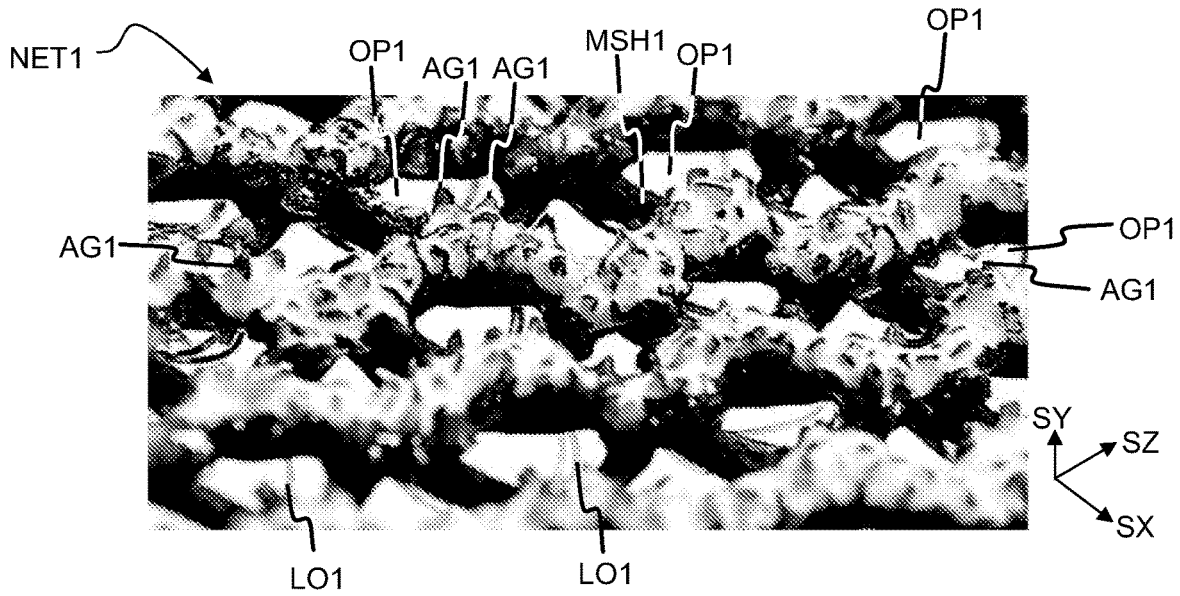
FIG. 7*a* is a microscope image of an abrasive mesh.

FIG. 7*a* shows by way of example, a microscope image of an abrasive mesh NET1. For example, the abrasive mesh NET1 of FIG. 7*a* may be used for forming the grooves of the groove pattern PAT1 on the cylinder. The grit size of the abrasive grains AG1 of the abrasive mesh NET1 may be e.g. in the range of 60 to 120, advantageously substantially equal to 80. In case of a cylinder made of cast iron, the abrasive grains AG1 may comprise e.g. silicon carbide.

Figure 7B:
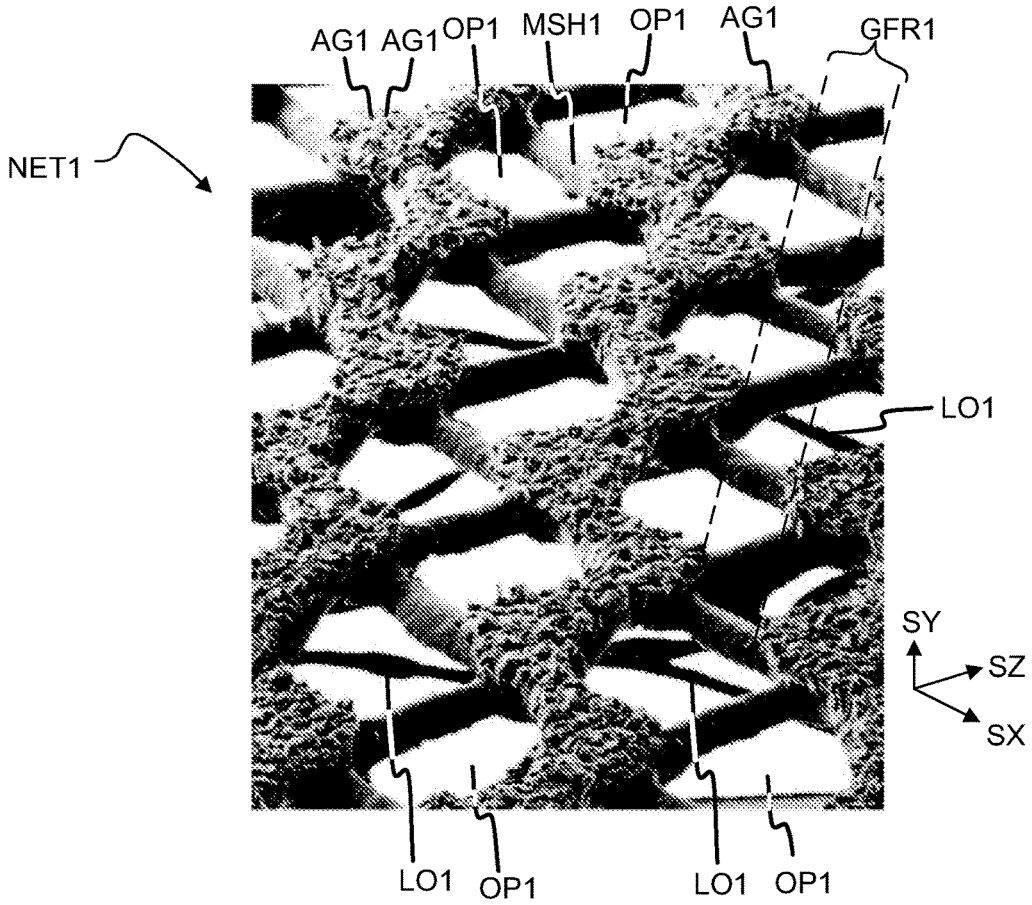
FIG. 7*b* is a microscope image of an abrasive mesh.

FIG. 7*b* shows by way of example, a microscope image of an abrasive mesh NET1. The abrasive grains AG1 of FIG. 7*b* are substantially smaller than the abrasive grains AG1 of FIG. 7*b*. For example, the abrasive mesh NET1 of FIG. 7*b* may be used for removing small protrusions BRR1 from the cylinder surface, after the grooves of the groove pattern PAT1 have been formed. The grit size of the abrasive grains AG1 of the abrasive mesh NET1 may be e.g. in the range of 180 to 400, advantageously substantially equal to 240.

One or more portions GFR1 of the abrasive mesh NET1 may be substantially free of abrasive grains. One or more portions of the first major surface of the flexible backing MSH1 may be substantially grain-free regions GFR1. The grain-free portions may reduce the average number density of the abrasive grains. The grain-free portions GFR1 may reduce the average number of abrasive grains per unit area of the abrasive mesh NET1.

Figure 8:
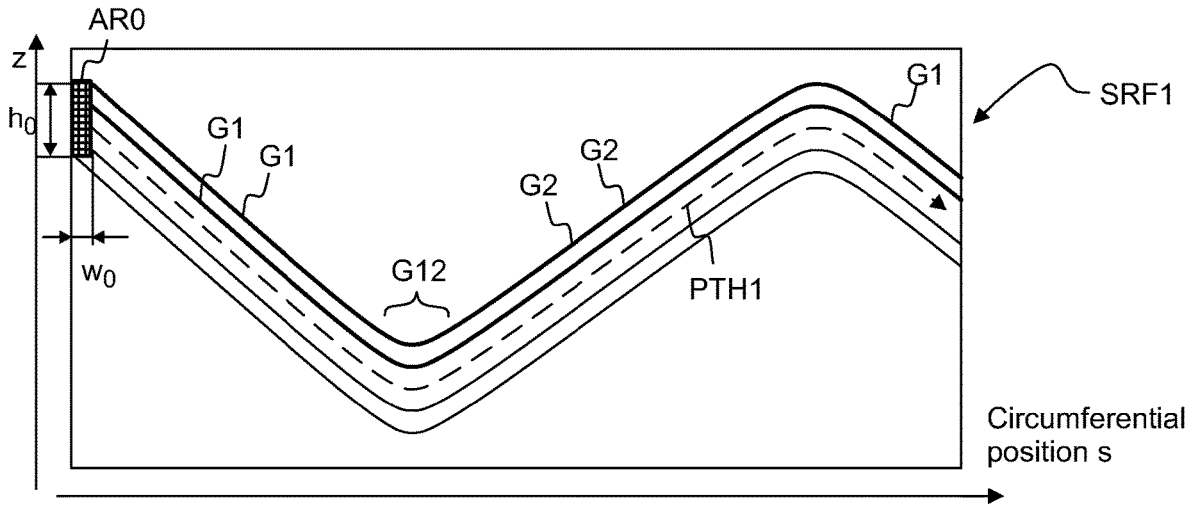
FIG. 8 shows, by way of example, grooves formed on the cylinder by a single abrasive module of the patterning head during a single rotation of the patterning head.

Referring to FIG. 8, the abrasive mesh article 110 of an abrasive module 100 may have an area AR0. The area AR0 may be defined by the height $h_0$ and the width $w_0$ of the article 110. The abrasive module 100 may be moved along a zigzag path PTH1 during forming of the groove pattern PAT1. The rotating module 100 may form first grooves G1 when the patterning head HEAD1 is moved in a first axial direction (e.g. in the direction −SZ). The rotating module 100 may form second grooves G2 when the patterning head HEAD1 is moved in a second axial direction (e.g. in the direction SZ). G12 denotes a groove portion, which joins a first groove G1 to a second groove G2.

The axial velocity $v_{AX1}$ of the patterning head HEAD1 may be controlled according to the axial position z in order to form a desired groove pattern PAT1. The axial velocity $v_{AX1}$ may be changed abruptly or smoothly at the end of the longitudinal stroke of the patterning head HEAD1. The axial velocity $v_{AX1}$ may be varied according to the axial position z of the patterning head HEAD1. A desired radius of the groove portion G12 may be produced by controlling the ratio $v_{AX1}/\omega_1$ of the axial velocity $v_{AX1}$ to the angular velocity ω1 near the end of the longitudinal stroke of the patterning head HEAD1.

Figure 9:
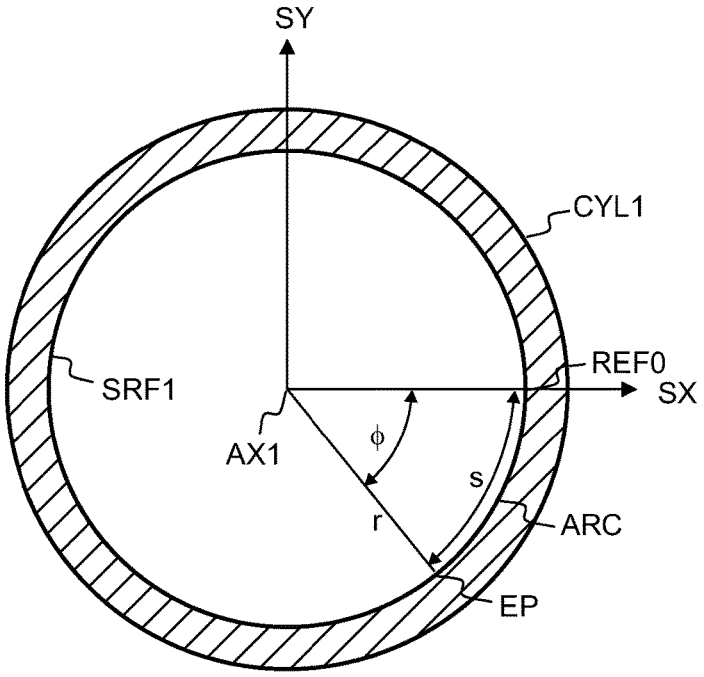
FIG. 9 shows the relationship between an angular position and the corresponding circumferential position.

FIG. 9 shows the relation between the angular position ϕ of a point EP of the cylinder surface SRF1 and the circumferential position s of said point EP. A reference plane REF0 may be defined by the directions SX and SZ such that the reference plane REF0 includes the axis AX1. The circumferential position s of a point EP of the cylindrical surface SRF1 may denote the length of the arc ARC along the surface SRF1 from the reference plane REF0 to the point EP, e.g. in the clockwise direction. The circumferential position s may be equal to ϕ·r in a situation where the angular position is expressed in radians.

Figure 10A:
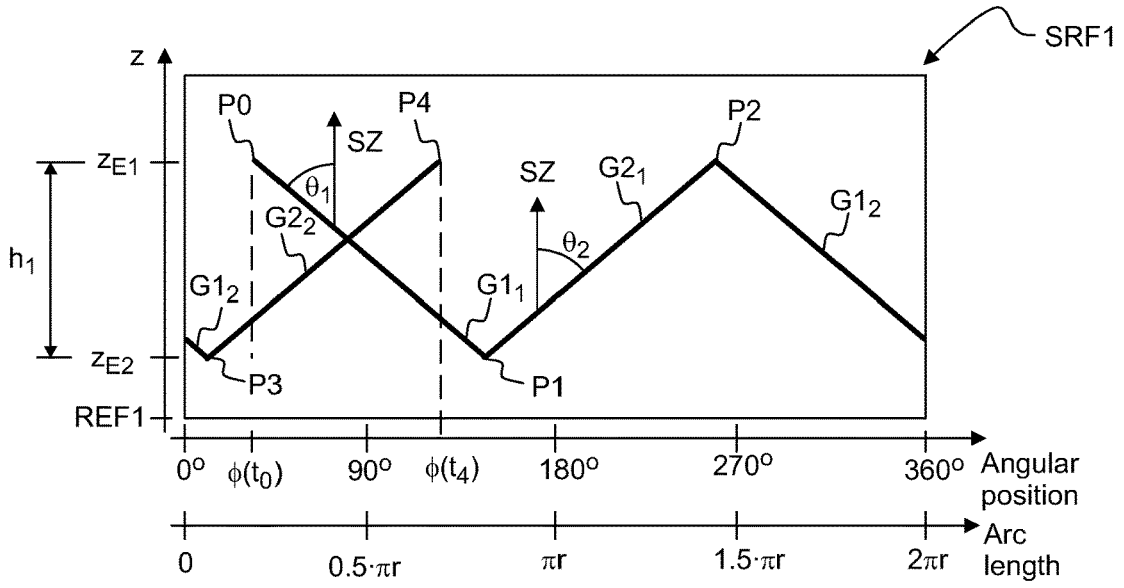
FIG. 10*a* shows, by way of example, groove portions formed by a single abrasive grain during four axial strokes of the patterning head.
Figure 10B:
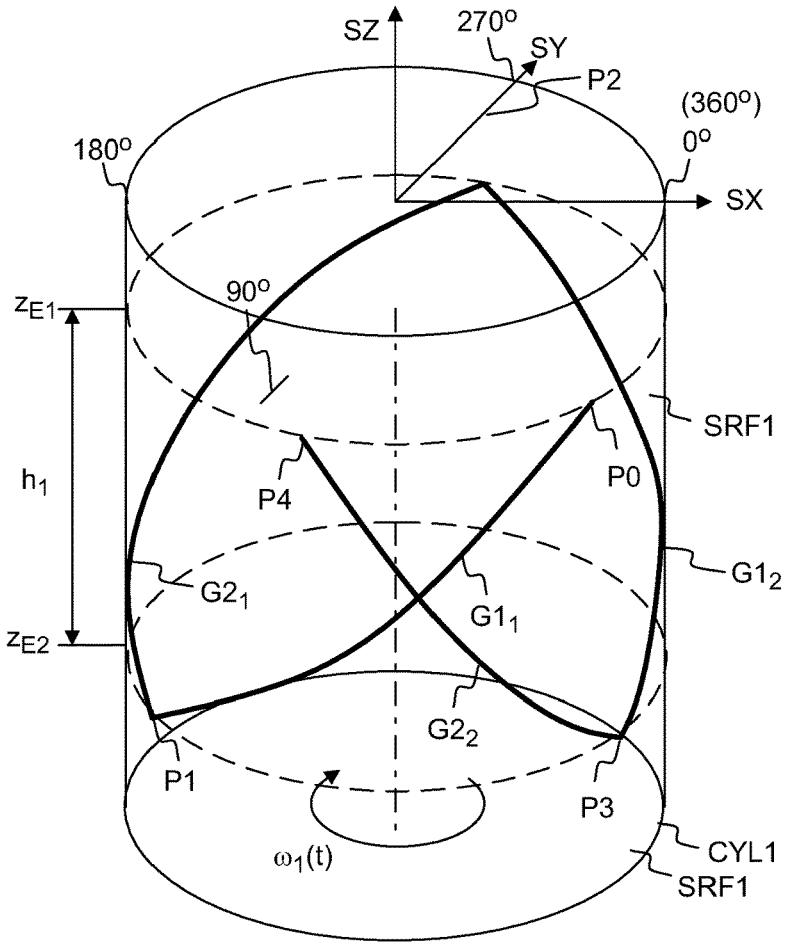
FIG. 10*b* shows, by way of example, in a three-dimensional view, the groove portions of FIG. 10*a*.

FIGS. 10*a* and 10*b* show, by way of example, grooves $G_{11}$, $G_{21}$, $G_{12}$, $G_{22}$ formed by a single abrasive grain AG1 during four consecutive axial movements (strokes) of the patterning head HEAD1. The single abrasive grain AG1 may be located e.g. in the center of an abrasive module 100, and the grooves $G_{11}$, $G_{21}$, $G_{12}$, $G_{22}$ may be interpreted to indicate the path traveled by the abrasive module 100 with respect to the surface SRF1.

The abrasive module 100 comprises a plurality of other abrasive grains in addition to the single grain. The grains may simultaneously form a plurality of parallel grooves, but only the grooves formed by the single grain are shown in FIGS. 10*a* and 10*b*.

The grooves $G1_1$ and $G1_2$ may be formed when the abrasive module 100 is moved from a first axial position $z_{E1}$ to a second axial position $z_{E2}$, and the grooves $G2_1$ and $G2_2$ may be formed when the abrasive module 100 is moved back from the second axial position $z_{E2}$ to the first axial position $z_{E1}$. The path of the center of the abrasive module 100 may include corner points P0, P1, P2, P3, P4. The axial distance between the corner points is equal to the length h1 of the axial stroke of the abrasive module 100.

The axial position z of a point may be defined e.g. with respect to a reference point REF1. The reference point REF1 may be e.g. at an end of the cylinder CYL1 (FIG. 1*b*).

Figure 11A:
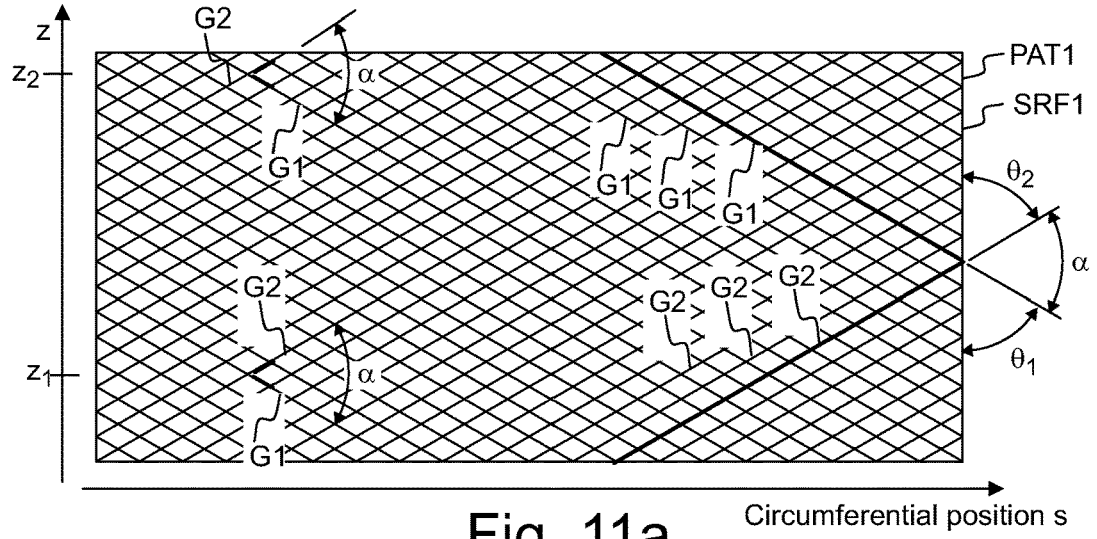
FIG. 11*a* shows, by way of example, a groove pattern formed on the cylinder.
Figure 11B:
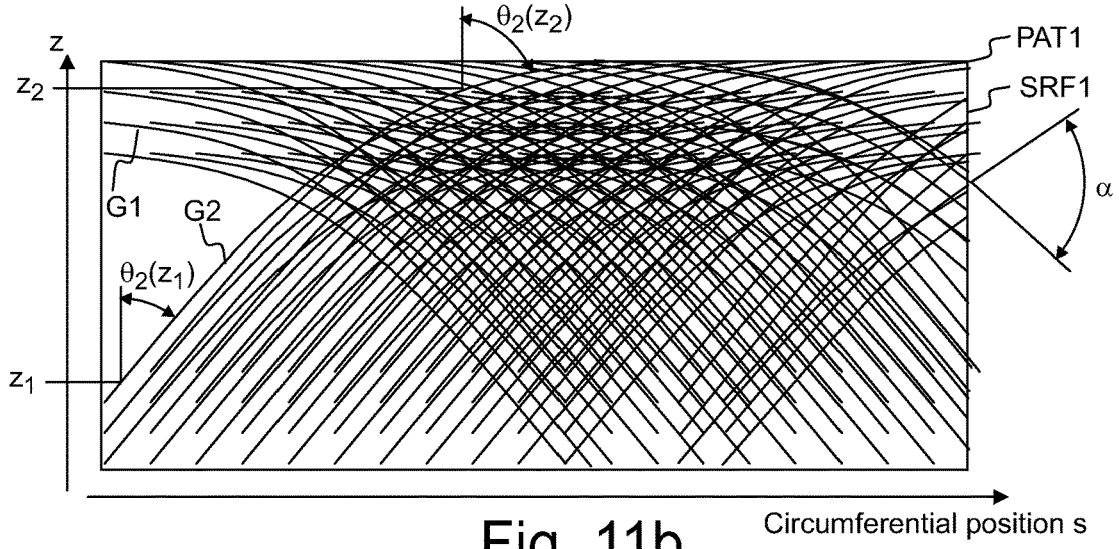
FIG. 11*b* shows, by way of example, a groove pattern formed on the cylinder.

Referring to FIGS. 11*a* to 11*b*, the abrasive grains AG1 of abrasive modules of a rotating patterning head HEAD1 may form first grooves G1 when the head HEAD1 is moved in a first axial direction (e.g. in the direction −SZ). The abrasive grains AG1 of abrasive modules of the rotating patterning head HEAD1 may form second grooves G2 when the head HEAD1 is moved in a second opposite axial direction (e.g. in the direction +SZ).

The orientation of the first grooves G1 may be specified e.g. by an angle $\theta_1$. The orientation of the second grooves G2 may be specified e.g. by an angle $\theta_2$. The angle $\theta_1$ may denote the angle between a first groove G1 and the direction of the axis AX1. The angle $\theta_2$ may denote the angle between a second groove G2 and the direction of the axis AX1. The crosshatch angle α may denote the angle between a first groove G1 and a second groove G2. The crosshatch angle α between the first groove G1 and the second groove G2 is equal to $180°-(\theta_1+\theta_2)$. The crosshatch angle α may also be called e.g. as the honing angle.

In case of a cylinder CYL1 of an internal combustion engine ICE1, the orientation angle $\theta_1$ may be e.g. in the range of 30° to 85°, advantageously in the range of 50° to 75°.

In case of a cylinder CYL1 of an internal combustion engine ICE1, the crosshatch angle α may be e.g. in the range of 10° to 120°, advantageously in the range of 30° to 80°.

The orientation angle $\theta_1$ of the first grooves G1 may be substantially equal to the orientation angle $\theta_2$ of the second grooves G2, e.g. in order to avoid undesired rotation of the piston rings RING1 during operation of the engine ICE1.

FIG. 11*a* shows an example where the crosshatch angles α of the grooves of the groove pattern PAT1 have substantially the same value at each point of the groove pattern PAT1. The crosshatch angle α of the groove pattern PAT1 may be substantially independent of the axial position z.

The crosshatch angles α of the grooves of the groove pattern PAT1 at a first axial position $z_1$ may be substantially equal to the crosshatch angles α of the grooves of the groove pattern PAT1 at a second axial position $z_1$.

The first axial position $z_1$ may be e.g. the axial position of the piston at the top dead center, and the second axial position $z_2$ may be e.g. the axial position of the piston at the bottom dead center.

Each abrasive module 100*a*, 100*b*, 100*c* of the pressing head HEAD1 may be pressed against the surface SRF1 with a pressing force FN1. The pressing force FN1 may be controlled according to the axial position (z) of the abrasive modules 100*a*, 100*b*, 100*c*. For example, the pressing force FN1 may have a predetermined value between a first axial position and a second axial position. For example, the pressing force FN1 may be reduced or switched to zero when the abrasive modules 100*a*, 100*b*, 100*c* are outside the region defined by the first and the second axial positions, in order to accurately define the direction of the grooves near the upper and/or lower parts of the groove pattern PAT1.

Referring to FIG. 11*b*, the crosshatch angle α may depend on the axial position z. For example, the average value of crosshatch angle $\alpha(z_1)$ at a first axial position $z_1$ may be substantially different from the average value of the crosshatch angle $\alpha(z_2)$ at a second axial position $z_2$.

The method may comprise controlling the ratio $(v_{AX1}/\omega 1)$ of the axial velocity $(v_{AX1})$ to the angular velocity (ω1) as a function of the axial position z of the abrasive modules with respect to the surface SRF1.

For example, the average value of the crosshatch angle α at a first axial position $z_1$ may be substantially smaller than the average value of the crosshatch angle α at a second axial position $z_2$, e.g. in order to provide more effective lubrication for the piston at the top dead center.

Figure 11C:
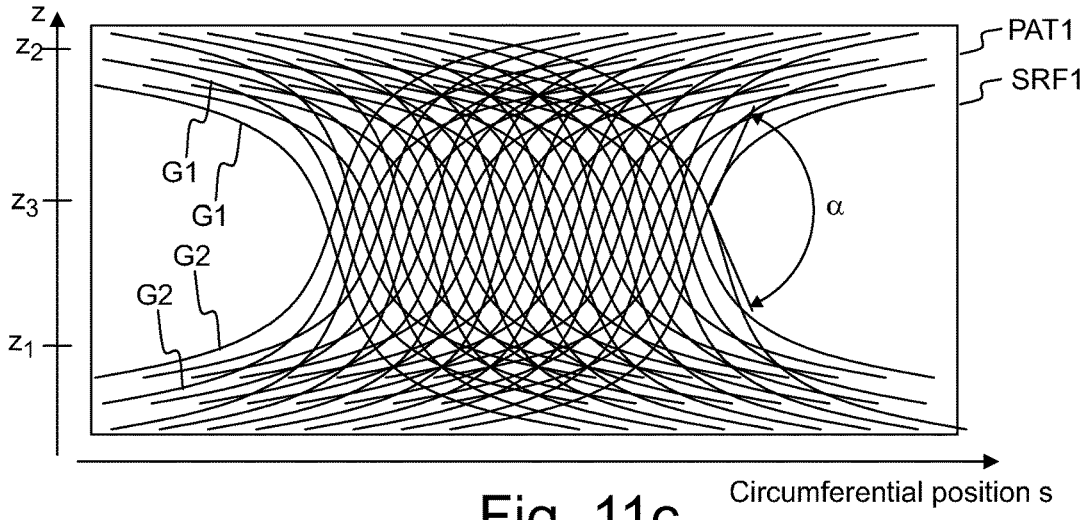
FIG. 11*c* shows, by way of example, a groove pattern formed on the cylinder.

Referring to FIG. 11*c*, the average value of the crosshatch angle α of the produced groove pattern PAT1 may depend on the axial position. For example, the average value of the crosshatch angle α at the center $(z_3)$ of the stroke of the piston may be greater than the average value of the crosshatch angle α at the top dead center $(z_1)$ of the piston and greater than the average value of the crosshatch angle α at the bottom dead center $(z_2)$ of the piston.

Figure 12A:
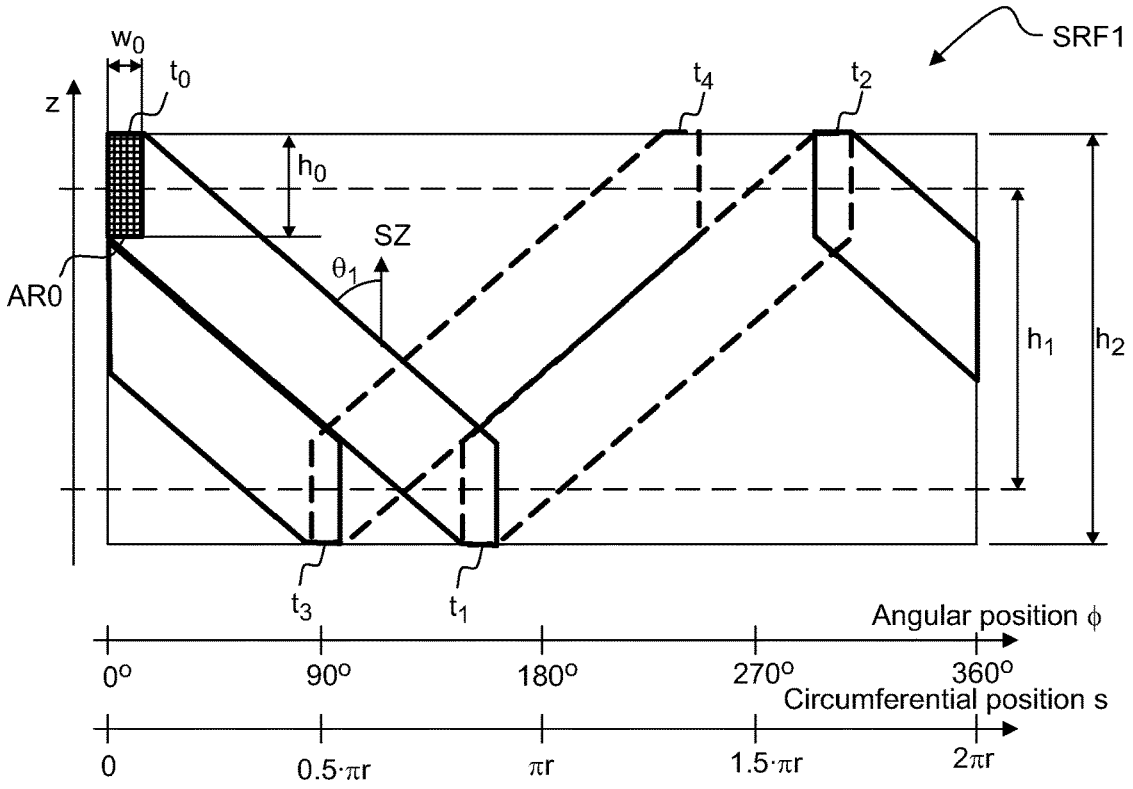
FIG. 12*a* shows, by way of example, surface portions wiped by a single abrasive module during four strokes of the patterning head.

Referring to FIG. 12*a*, the abrasive mesh article 110 of an abrasive module 100 may have an area $AR_0$ defined by the height $h_0$ and the width $w_0$. The abrasive module 100 may move along a zigzag path during a time period between times $t_0$ and $t_4$. FIG. 12*a* shows surface regions reached by the abrasive mesh article 110 during four consecutive axial movements (strokes) of the module 100, i.e. during two reciprocating movements. $h_1$ denotes the axial dimension of the stroke of the module 100. $h_2$ denotes the maximum axial dimension of the formed groove pattern PAT1.

The method may comprise reversing the axial velocity of the patterning head HEAD1 during forming the groove pattern PAT1. Forming the groove pattern PAT1 may comprise performing a number $N_{AX1}$ of axial movements of the patterning head HEAD1, wherein the number $N_{AX1}$ may be e.g. in the range of 4 to 1000.

Figure 12B:
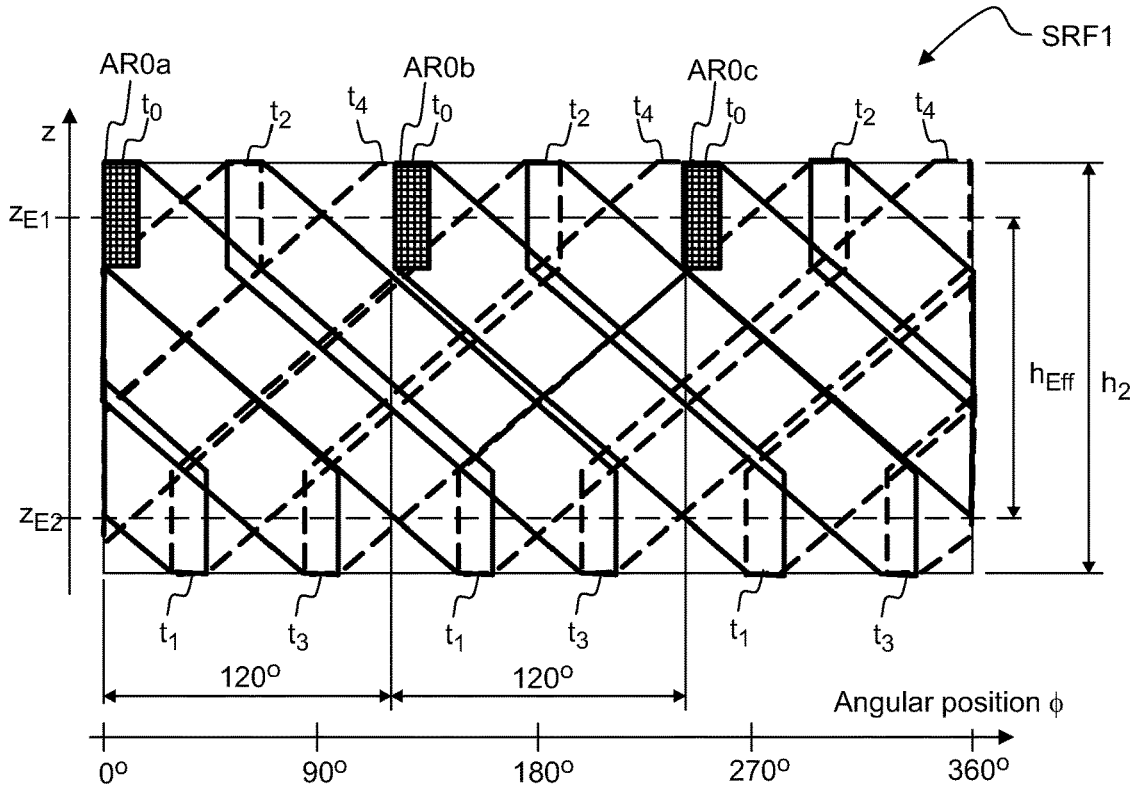
FIG. 12*b* shows, by way of example, surface portions wiped by three abrasive modules during four strokes of the patterning head.

FIG. 12*b* shows surface regions reached by three simultaneously moving abrasive mesh articles of a patterning head HEAD1. A first article 110*a* may have an area AR0*a*, a second article 110*b* may have an area AR0*b*, and a third article 110*c* may have an area AR0*c*.

Each abrasive mesh article 100*a*, 100*b*, 100*c* may move along a zigzag path during a time period between times $t_0$ and $t_4$. FIG. 12*b* shows surface regions reached by the abrasive mesh articles during four consecutive axial strokes of the module 100, i.e. during two reciprocating movements. The patterning head HEAD1 may be at an upper axial position at times $t_0$, $t_2$ and $t_4$, and the patterning head HEAD1 may be at a lower axial position at times $t_1$ and $t_3$.

The abrasive mesh articles 110*a*, 110*b*, 110*c* may together reach substantially each point of a surface region between a first axial position $z_{E1}$ and a second axial position $z_{E2}$ during four consecutive axial strokes of the modules, i.e. during two reciprocating movements. The height $h_0$ of the abrasive modules 100*a*, 100*b*, 100*c* may be selected according to the diameter $d_{SRF1}$ of the cylinder CYL1 and according to a desired cross hatch angle α such that the effective height $h_{Eff}$ of the formed groove pattern PAT1 may be greater than or equal to a target height of the groove pattern PAT1. The target height of the groove pattern PAT1 may be e.g. greater than or equal to a minimum height of an oil film FILM1 needed for lubricating the cylinder CYL1 of an operating engine ICE1. The target height of the groove pattern PAT1 may be e.g. greater than or equal to the sum of the length $(h_s)$ of the piston stroke and a height $(h_P)$ of the piston (see FIG. 1*a*).

The total area $A_{TOT}$ of the articles 110*a*, 110*b*, 110*c* may be selected according to the desired area $A_{PAT1}$ of the groove pattern PAT1. The total area $A_{TOT}$ may be e.g. in the range of 1% to 25% of the area $A_{PAT1}$ of the groove pattern PAT1.

If the total area of the articles 110*a*, 110*b*, 110*c* is very small, then a large fraction of the abrasive grains may be become dull before forming of the pattern is completed. Consequently, the articles 110*a*, 110*b*, 110*c* may need to be replaced before the pattern is completed.

Selecting a relatively large area for the articles 110*a*, 110*b*, 110*c* may provide more consistent performance and/or may improve stability of the abrasive modules. The total area $A_{TOT}$ may be e.g. in the range of 5% to 25% of the area $A_{PAT1}$ of the groove pattern PAT1, e.g. in order to provide stable operation.

The pressing force FN1 may be selected e.g. according to the area of the articles 110*a*, 110*b*, 110*c* and/or according to the effective number density of the abrasive grains of the articles 110*a*, 110*b*, 110*c*.

To the first approximation, the area $A_{PAT1}$ of the groove pattern PAT1 may be equal to $h_{PAT1} \times 2\pi r_{SRF1}$. The total area $A_{TOT}$ of the articles may be equal to $N_{110} \times h_0 \times w_0$. $N_{110}$ may denote the number of the articles of the patterning head HEAD1.

Worn abrasive mesh articles 110 may be replaced with new abrasive mesh articles 110 e.g. each time after forming of a pattern PAT1 has been completed. The pressing force FN1 may be selected so as to optimize the operating life of the abrasive mesh articles 110. If the pressing force FN1 is too high, then a majority of the abrasive grains AG1 may be fractured and/or may become dull before forming of the pattern PAT1 has been completed. If the pressing force FN1 is too low, then the depth of the grooves G1, G2 may remain too low. Grooves formed in the beginning of the patterning operation may have an average depth $d_{G,AVE1}$. Grooves formed in the end of the patterning operation may have an average depth $d_{G,AVE2}$. The pressing force FN1 may be selected e.g. such that the ratio $d_{G,AVE2}/d_{G,AVE1}$ is e.g. in the range of 50% to 95%.

The abrasive grains may form grooves on the cylinder surface SRF1. The number density of the grooves should preferably be in a desired range. If the number density of the grooves is too low, then the grooves do not retain a sufficient amount of lubricating oil. If the number density of the grooves is too high, then the relative area of smooth portions remaining between adjacent grooves may be so low that the cylinder surface cannot support a proper lubricating oil film during operation of the engine.

If the abrasive articles 110 travel too many times over the same portion of the cylinder surface SRF1, then the relative surface area covered by the grooves may become so high that the portion cannot support a proper lubricating film FILM1 during operation of the engine.

The patterning head HEAD1 may be arranged to rotate $N_{ROT}$ times about the axis AX1 during forming of the groove pattern PAT1. The number $N_{ROT}$ may be selected such that the number density of the grooves may be in a desired range. For example, the number $N_{ROT}$ may be selected according to the height $h_{eff}$ of the groove pattern PAT1, according to the height $h_0$ of the abrasive articles 110, and according to the number $N_{110}$ of the abrasive articles 110 of the patterning head HEAD1.

The number $N_{ROT}$ may be equal to $f_{ROT} \cdot T_{PAT1}$, where the symbol $f_{ROT}$ denotes the rotation speed $f_{ROT}$ and the symbol $T_{PAT1}$ denotes the duration $T_{PAT1}$ of the patterning operation. The number $N_{ROT}$ may depend on the duration $T_{PAT1}$ e.g. when using a predetermined rotation speed $f_{ROT}$. The duration $T_{PAT1}$ of the patterning operation may be selected such that the relative surface area of the grooves (G1, G2) remains below a predetermined limit at each point of the surface SRF1 which is in contact with the piston.

The cylinder may be prepared for the patterning operation such that the cylinder has a substantially smooth initial surface before forming the grooves. A large relative fraction of the surface area may remain smooth during forming the grooves. The duration $T_{PAT1}$ of the patterning operation may be selected such that that the final surface SRF1 of the cylinder has a sufficient number of oil-retaining grooves G1, and wherein the final surface SRF1 also has substantially smooth surface portions between the grooves G1 to bear the load of the piston. The grooves may together cover e.g. less than 50% of the total area of the produced groove pattern. The grooves may together cover e.g. less than 20% of the total area of the produced groove pattern. The combined area of the smooth portions remaining between the grooves may be e.g. in the range of 50% to 95% of the area covered by the groove pattern PAT1.

The duration $T_{PAT1}$ of the patterning operation may be selected such that the produced grooves together cover e.g. less than 50% of the total area of the produced groove pattern, wherein the combined area of the smooth portions remaining between the produced grooves may be e.g. in the range of 50% to 95% of the area covered by the groove pattern PAT1.

The duration $T_{PAT1}$ of the patterning operation may be selected such that the abrasive mesh articles 110 of the group GRP1 travel over each point of the groove pattern PAT1 not more than 200 times, preferably not more than 100 times. The duration $T_{PAT1}$ of the patterning operation may be selected such that the abrasive mesh articles 110 of the group GRP1 reach each point of the groove pattern PAT1 not more than 200 times, preferably not more than 100 times.

Figure 12C:
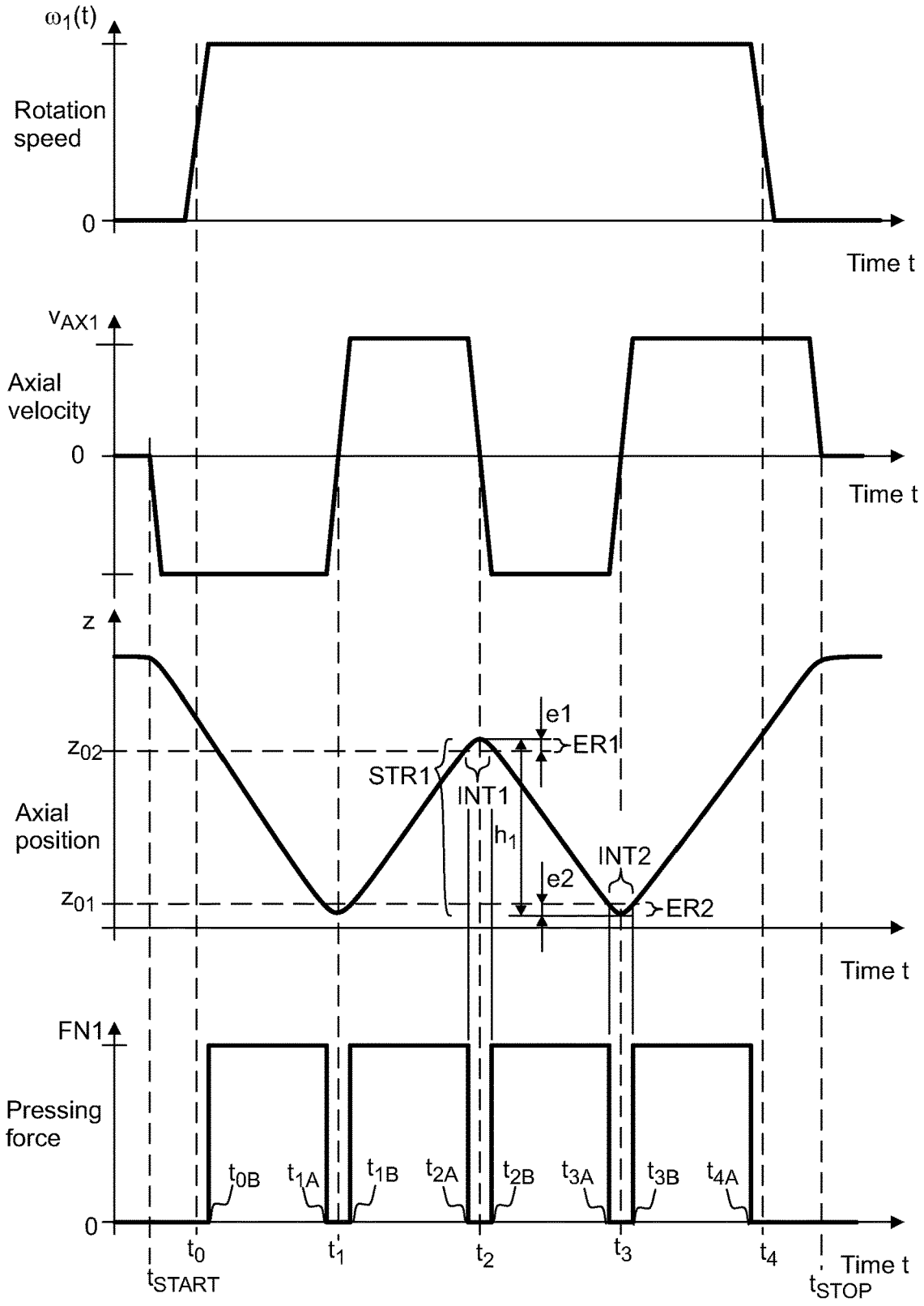
FIG. 12*c* shows, by way of example, temporal evolution of rotation speed, axial velocity, axial position, and pressing force, for moving the patterning head according to FIG. 12*b*.

FIG. 12*c* shows, by way of example, temporal evolution of rotation speed, axial velocity, axial position, and pressing force, for moving the patterning head HEAD1 according to FIG. 12*b*. The axial movement may be started at the time $t_{START}$ so as to insert the patterning head HEAD1 into the cylinder CYL1. The patterning head HEAD1 may reach a lowermost axial position e.g. at times $t_1$ and $t_3$. The abrasive modules 100 may form first grooves (G1) during the time period between the times $t_{0B}$ and $t_{1A}$. The abrasive modules 100 may form second grooves (G2) during the time period between the times $t_{1B}$ and $t_{2A}$. The abrasive modules 100 may form third grooves (G1) during the time period between the times $t_{2B}$ and $t_{3A}$. The abrasive modules 100 may form fourth grooves (G2) during the time period between the times $t_{3B}$ and $t_{4A}$. The patterning head HEAD1 may have substantially constant angular and axial speed during said time periods when the abrasive modules 100 are pressed against the cylinder surface SRF1. The axial movement of the patterning head HEAD1 may be stopped at the time $t_{STOP}$, after the patterning head HEAD1 has been removed from the cylinder CYL1.

The control unit CNT1 of the apparatus 500 may be configured to control the axial velocity $v_{AX1}$ of the abrasive module 100 and/or the pressing force FN1 of the pressing actuator 140 according to the axial position z of the abrasive module 100. $h_1$ may denote the axial dimension of the stroke STR1, e1 may denote axial dimension of a first end region ER1, and e2 may denote axial dimension of a second end region ER2. The apparatus 500 may be arranged to provide a reduced pressing force FN1 at an end region ER1, ER2 of the stroke STR1. The abrasive module 100 may be at a first end region ER1 during a first time period INT1 (e.g. between times $t_{2A}$,$t_{2B}$). The abrasive module 100 may be at a second end region ER2 during a second time period INT2 (e.g. between times $t_{3A}$,$t_{3B}$).

The axial velocity $v_{AX1}$ may be gradually changed at end regions ER1, ER2 of an axial stroke STR1, e.g. in order to reduce acceleration forces. Gradual reversal of the axial velocity $v_{AX1}$ at the ends of the strokes may form curved and/or horizontal groove portions G12.

Figure 12D:
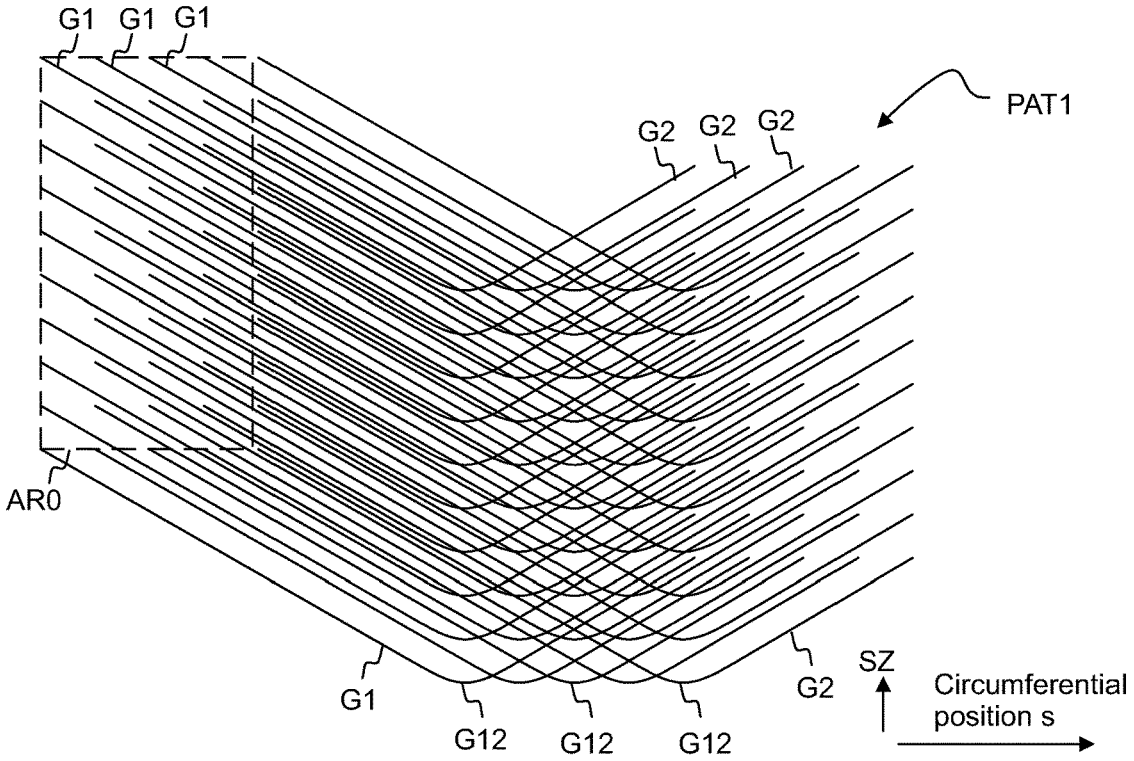
FIG. 12*d* shows, by way of example, a groove pattern formed on the cylinder surface in a situation where an abrasive module is continuously pressed against the cylinder surface during reversing the axial velocity.

FIG. 12*d* shows, by way of example, first inclined grooves G1 formed when an abrasive module moves in a first axial direction (e.g. −SZ, downwards) at a substantially constant axial velocity $v_{AX1}$. Second inclined grooves G1 may be formed when an abrasive module moves in an opposite axial direction (e.g. +SZ, upwards) at a substantially constant axial velocity $v_{AX1}$. FIG. 12*d* also shows curved groove portions G12, which may be formed when the abrasive module is pressed against the cylinder surface during gradual reversal of the axial velocity. Each curved groove portion G12 may join a first inclined groove G1 to a second inclined groove G2.

The groove pattern may comprise substantially horizontal portions G12, which may be substantially perpendicular to the direction of movement of the piston, which moves in the cylinder. The formed groove pattern may comprise substantially horizontal groove portions G12. For some applications, the orientation of the horizontal groove portions may be outside a desired angular range. The pressing force FN1 may be reduced during the gradual reversal of axial velocity, e.g. in order to avoid producing the curved and/or horizontal groove portions G12.

Figure 12E:
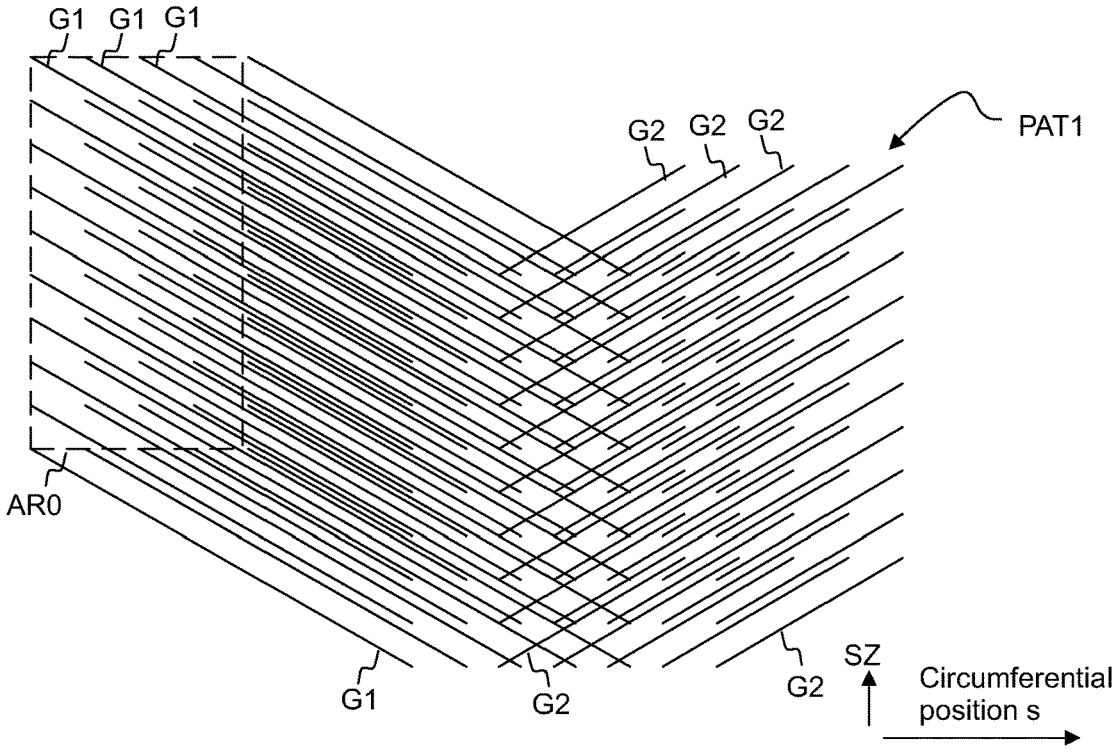
FIG. 12*e* shows, by way of example, a groove pattern formed on the cylinder surface in a situation where the pressing force is temporarily reduced in the end region of the longitudinal stroke.

FIG. 12*e* shows, by way of example, a groove pattern PAT1 where substantially all formed grooves may be inclined grooves. Formation of curved and/or horizontal groove portions G12 may be avoided by using a reduced pressing force FN1 during the gradual reversal of axial velocity at the end of the stroke. For example, the apparatus 500 may be arranged to operate such that the pressing force FN1 is substantially equal to zero when the axial position of the patterning head is outside the axial range defined by the positions $z_{01}$, $z_{02}$ shown in FIG. 12*c*.

Figure 12F:
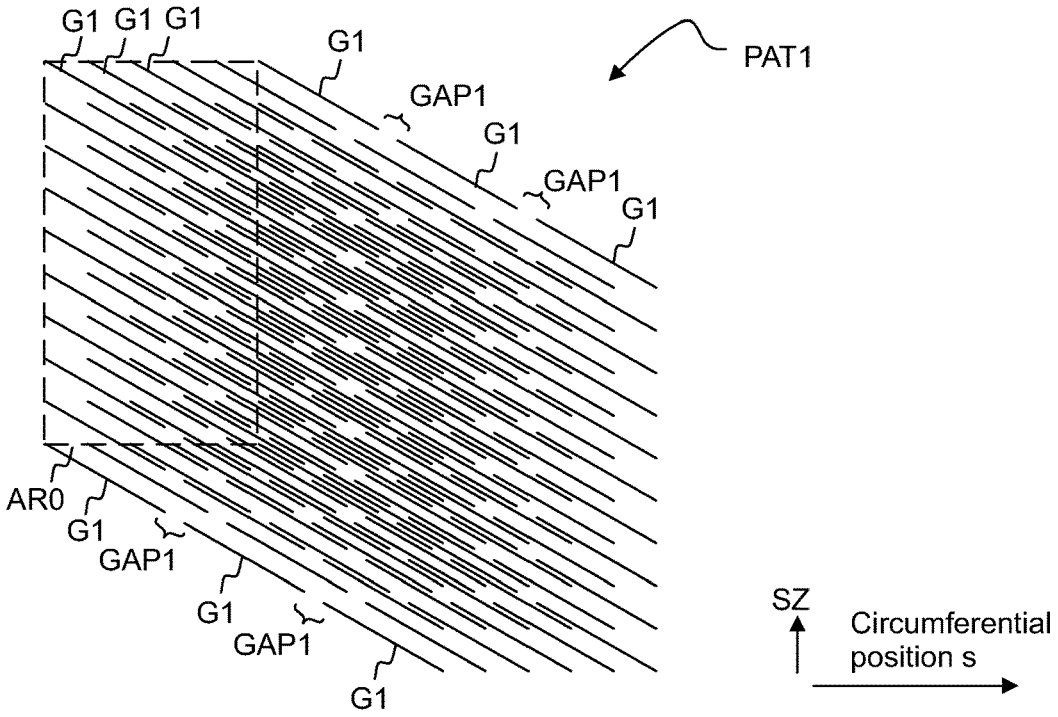
FIG. 12*f* shows, by way of example, broken grooves formed by varying the pressing force during a longitudinal stroke.

FIG. 12*f* shows, by way of example, a groove pattern PAT1, which comprises broken grooves G1. The broken grooves may have an effect on the lubricating properties of the oil film. The method may comprise forming broken grooves G1 by temporarily reducing the pressing force FN1 during a stroke. The method may comprise forming broken grooves G1 by repetitively switching on and off the pressing force FN1 during performing one or more axial strokes of the patterning head. A broken groove may comprise a first groove portion formed by an abrasive grain and a second groove portion formed by the same abrasive grain, wherein said groove portions may be separated by a gap GAP1. The broken grooves may also be called e.g. as non-continuous grooves, dashed grooves or interrupted grooves. The groove pattern PAT1 may comprise a plurality of discontinuities GAP1, which separate the groove portions. The length of a single groove portion of a broken groove may be e.g. substantially smaller than the length $h_1$ of the axial stroke.

The pressing force FN1 may be switched on and off several times during a single axial movement of the patterning head HEAD1, to form a plurality of groove sections. Forming several grove sections instead of a long groove may improve the capability to retain the lubricating oil film FILM1.

Figure 13:
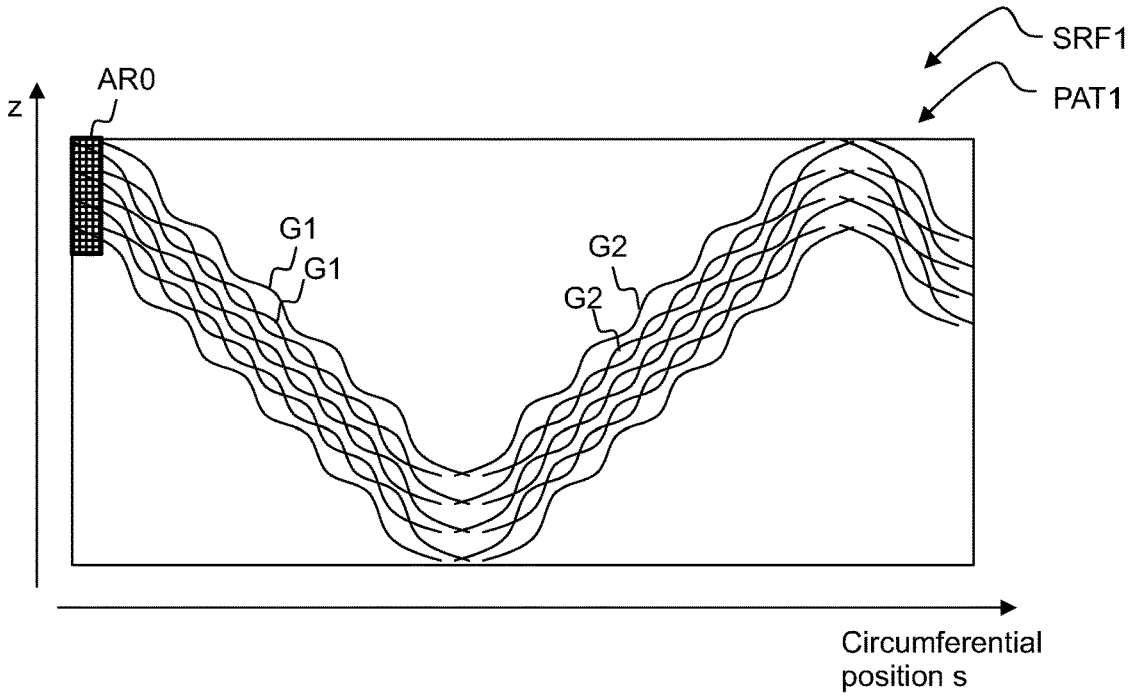
FIG. 13 shows, by way of example, wavy grooves formed by varying the axial velocity component of the patterning head.

Referring to FIG. 13, the patterning head HEAD1 may be arranged to produce wavy (undulating) grooves, by varying the ratio $v_{AX1}/\omega_1$ of the axial velocity $v_{AX1}$ to the angular velocity ω1. A groove pattern PAT1 comprising wavy grooves may improve retention of the lubricating oil. The axial velocity vAX1 may be modulated e.g. by controlling a stepper motor M2 of the positioning ZUNIT1. The apparatus 500 may comprise an auxiliary actuator for modulating the axial velocity $v_{AX1}$. The auxiliary actuator may comprise e.g. a crankshaft mechanism or a camshaft mechanism for providing an oscillatory axial component to an axial motion caused by the positioning ZUNIT1.

Figure 14A:
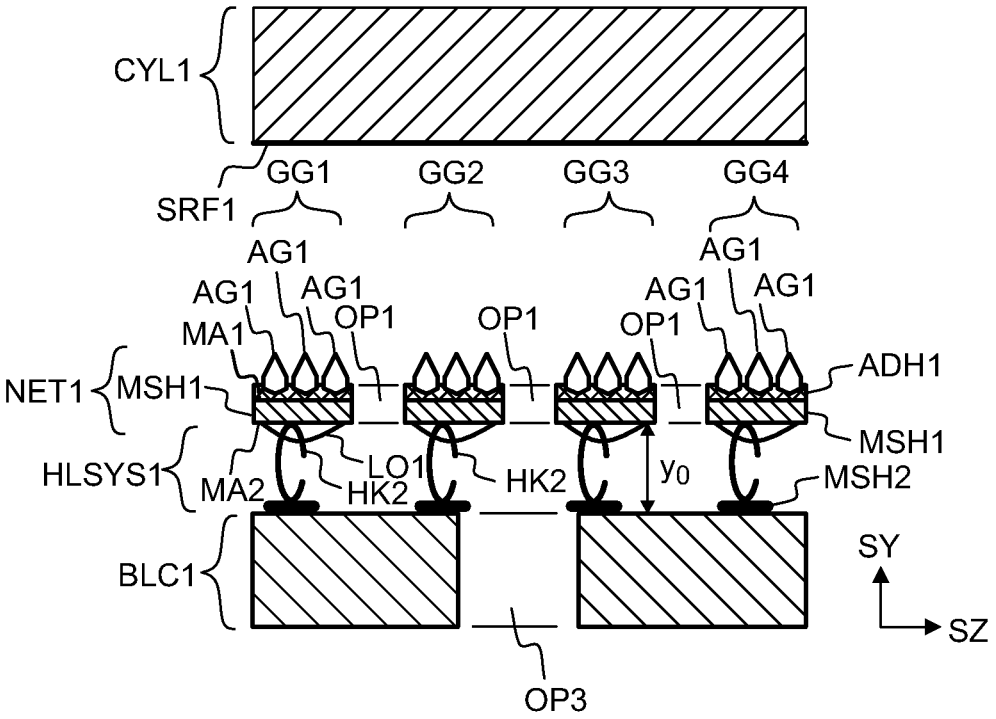
FIG. 14*a* shows, by way of example, in a cross-sectional side view, the abrasive mesh attached to the collector block.

FIGS. 14*a* to 14*d* illustrate forming a plurality of grooves G1 on the cylinder surface SRF1 by using the abrasive mesh NET1. Referring to FIG. 14*a*, the hooks HK2 of the hook and loop fastening system HLSYS1 may operate as miniature springs, which support the flexible backing MSH1 and the abrasive grains AG1. The flexible abrasive mesh NET1 may be understood to comprise a plurality of small regions, which are individually supported by the small hook-shaped springs HK2 of the hook and loop fastening system HLSYS1. A first region of the mesh NET1 may comprise a first group GG1 of abrasive grains AG1. A second region may comprise a second group GG2 of grains AG1. A third region may comprise a group GG3. A fourth region may comprise a group GG4. One or more first hooks HK2 may support the first region of the mesh NET1 beneath the first group GG1. One or more second hooks HK2 may support the second region of the mesh NET1 beneath the second group GG2. $y_0$ may denote an initial distance between the backing MSH1 and the block BLC1 in an initial situation where the abrasive mesh NET1 is not pressed against the cylinder surface SRF1.

Figure 14B:
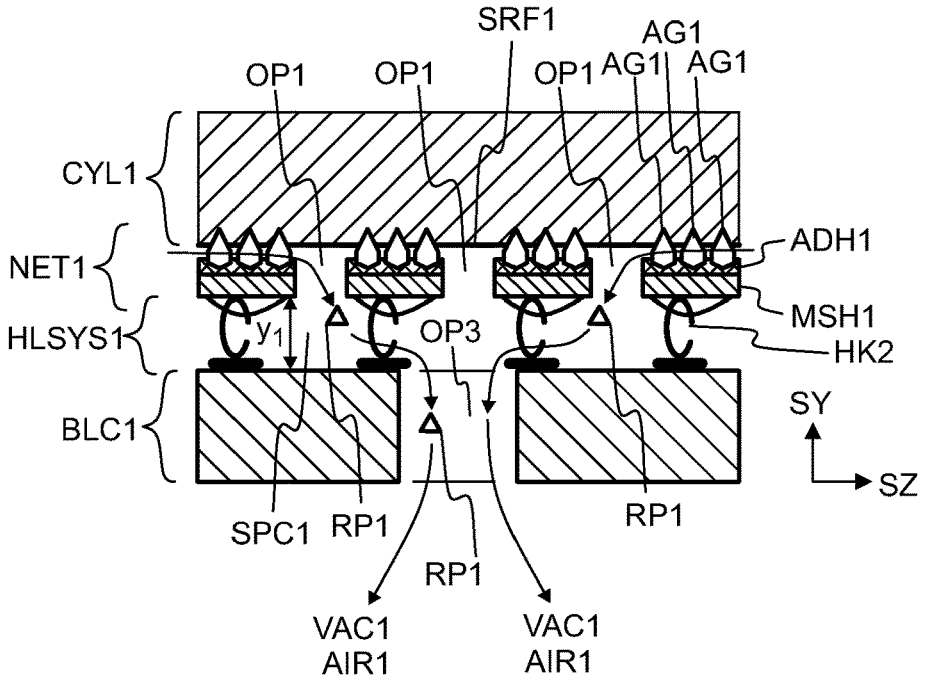
FIG. 14*b* shows, by way of example, in a cross-sectional side view, forming grooves by pressing the abrasive mesh against the cylinder surface.

Referring to FIG. 14*b*, the abrasive mesh NET1 may be pressed against the cylinder surface SRF1, so as to form the grooves G1. The hooks HK2 may transmit pressing forces from the block BLC1 to the flexible backing MSH1. $y_1$ may denote a distance between the backing MSH1 and the block BLC1 in the situation where the abrasive mesh NET1 is pressed against the cylinder surface SRF1. The distance $y_1$ may be smaller than the initial distance $y_0$ shown in FIG. 14*a*. To the first approximation, the pressing force transmitted by an individual hook HK2 may be proportional to the difference $y_0-y_1$. To the first approximation, the pressing force transmitted by a compressed hook HK2 from the block BLC to the abrasive mesh NET1 may be substantially proportional to the relative compression $(y_0-y_1)/y_0$. The compressed hooks HK2 may generate a pressure (i.e. force per unit area), which pushes the backing MSH1 towards the cylinder surface SRF1. To the first approximation, the pressure may be substantially proportional to the relative compression $(y_0-y_1)/y_0$.

The flexible abrasive mesh NET1 may be understood to comprise a plurality of regions (zones), which are individually supported by the small hook-shaped springs HK2 of the hook and loop fastening system HLSYS1. The hooks HK2 of the hook and loop fastening system HLSYS1 may operate as springs, which may effectively press different regions of the abrasive mesh NET1 against the surface SRF1. The combination of the abrasive mesh NET1 and the fastening system HLSYS1 may be locally resilient. The combination of the abrasive mesh NET1 and the fastening system HLSYS1 may be compressed by a distance $(y_0-y_1)$, which may be e.g. greater than 20% the initial height of the hooks HK2. The relative compression $(y_0-y_1)/y_0$ may be e.g. greater than 20% during the pressing.

The releasable fastening system HLSYS1 may provide a permeable region SPC1 for drawing released particles RP1 through the openings OP1 of the flexible mesh backing MSH1 to openings OP3 of the block BLC via the releasable fastening system HLSYS1.

The hook and loop fastening system HLSYS1 may also allow transverse movement of air AIR1 and released particles RP1 in the permeable region SPC1 defined between the backing MSH1 and the collector block BLC1. A released particle RP1 may be carried away by the air flow VAC1 via one of the openings OP1 of the backing MSH1, via the permeable region SPC1, and via one of the openings OP3 of the block BLC1. The hook and loop fastening system HLSYS1 may provide an intermediate space SPC1, which operates as a permeable layer for the released particles carried by the air flow.

Figure 14C:
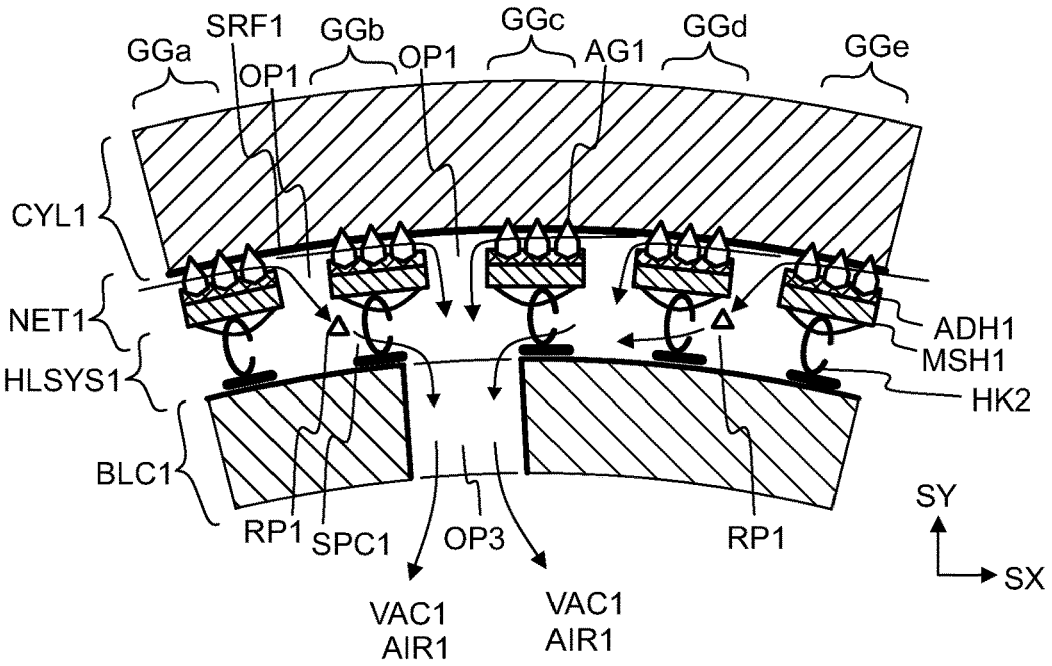
FIG. 14*c* shows, by way of example, in a cross-sectional axial view, forming the grooves by pressing the abrasive mesh against the cylinder surface.

FIG. 14*c* shows the operation of the abrasive mesh NET1 when viewed in the axial direction. The mesh NET1 may comprise groups (GGa, GGb, GGc, GGd, GGe) of abrasive grains AG1. The abrasive mesh NET1 may conform to the shape of the cylinder surface SRF1. Thanks to the flexible mesh NET1 and thanks to the resilient hook and loop fastening system HLSYS1, the abrasive mesh NET1 may accurately conform to the shape of the cylinder surface SRF1 also in a situation where the radius of curvature $r_{SRF3}$ of the block BLC would slightly deviate from an optimum value (e.g. due to manufacturing tolerances).

Figure 14D:
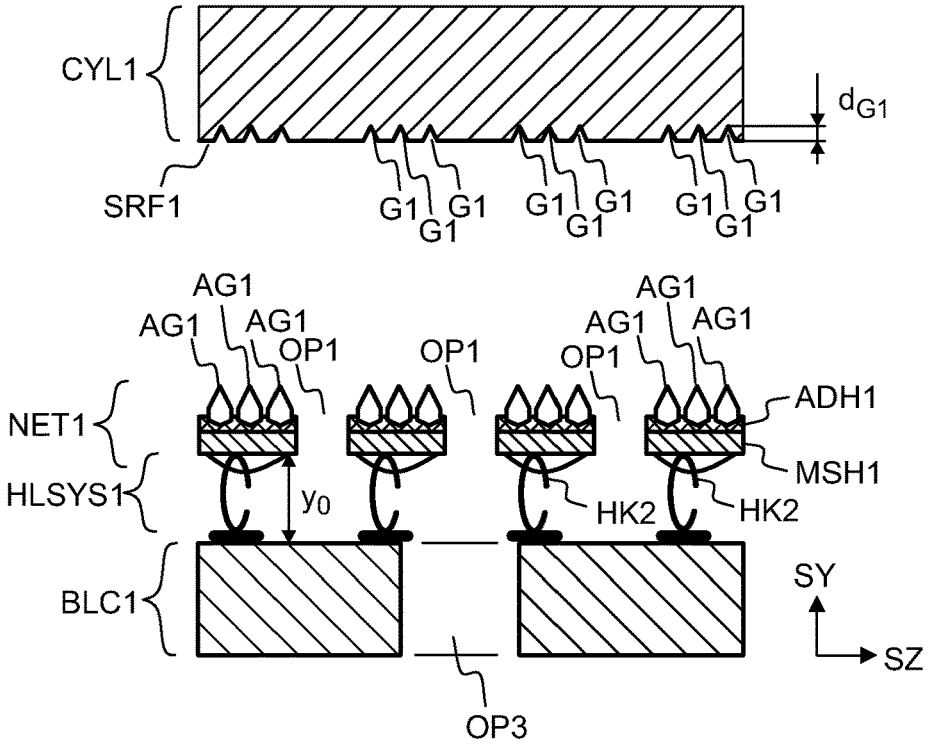
FIG. 14*d* shows, by way of example, in a cross-sectional side view, the grooves formed by pressing the abrasive mesh against the cylinder surface.
Figure 14E:
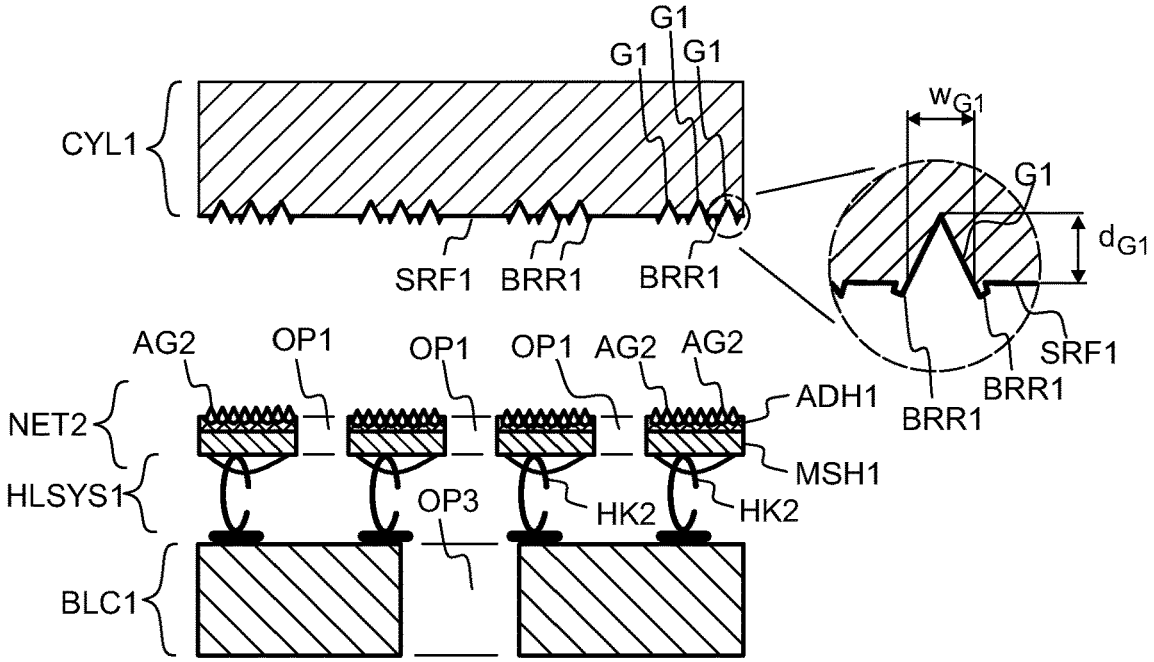
FIG. 14*e* shows, by way of example, in a cross-sectional side view, using a second abrasive mesh article for removing small protrusions from the cylinder surface.

Referring to FIG. 14*d*, the abrasive grains AG1 of the abrasive mesh NET1 may form a plurality of grooves G1 on the cylinder surface SRF1.

The grooves G1 shown in FIGS. 14*b* to 14*d* may be inclined with respect to the axis AX1 of the cylinder surface SRF1, according to the desired honing angle.

Referring to FIG. 14*e*, the edges of a groove G1 formed by a large abrasive grain AG1 may have protruding portions BRR1. The protruding portions BRR1 may be adjacent to the groove G1. The protruding portions BRR1 may be called e.g. as burr. The method may comprise a removing the protruding portions BRR1 by using a second different abrasive net NET2, which comprises smaller abrasive grains AG2 (see also FIG. 7*b*). The second abrasive net NET2 may be used after the grooves have been formed.

The grain size of the second abrasive net NET2 may be smaller than the grain size of the first abrasive net NET1 used for forming the grooves G1, G2. In particular, the second abrasive grains AG2 shown in FIG. 14*e* may be substantially smaller than the first abrasive grains AG1 shown in FIGS. 14*a* to 14*d*.

The grooves G1, G2 may be formed by using first grains AG1 of a first grit size selected from the range of 60 to 120 (FEPA P), and the protrusions BRR1 may be removed by using second grains AG2 of a second grit size selected from the range of 60 to 120 (FEPA P). The grit size may be determined according to the standard FEPA 43-1:2006 (Grains of fused aluminium oxide, silicon carbide and other abrasive materials for coated abrasives Macrogrits P 12 to P 220) and/or FEPA 43-2:2006 (Grains of fused aluminium oxide, silicon carbide and other abrasive materials for coated abrasives Microgrits P 240 to P 2500). The first grains AG1 may be e.g. silicon carbide grains to effectively form the grooves e.g. in cast iron, and the second grains AG2 may be e.g. aluminum oxide grains to effectively smooth out the protrusions.

The method may comprise forming a groove pattern PAT1 by using one or more first abrasive articles 110*a*, 110*b*, and removing protrusions BRR1 from the cylinder surface SRF1 by using one or more second abrasive articles 110*a*, 110*b*, wherein the average size of the abrasive grains AG1 of the first abrasive articles 110*a*, 110*b* may be larger than the average size of the abrasive grains AG1 of the second abrasive articles 110*a*, 110*b*.

$d_{G1}$ may denote the depth of a groove G1, and $w_{G1}$ may denote the width of the groove G1.

The abrasive mesh NET1 may be advantageously produced such that the peaks of the abrasive grains AG1 of the abrasive mesh NET1 are substantially at the same height level.

Figure 15:
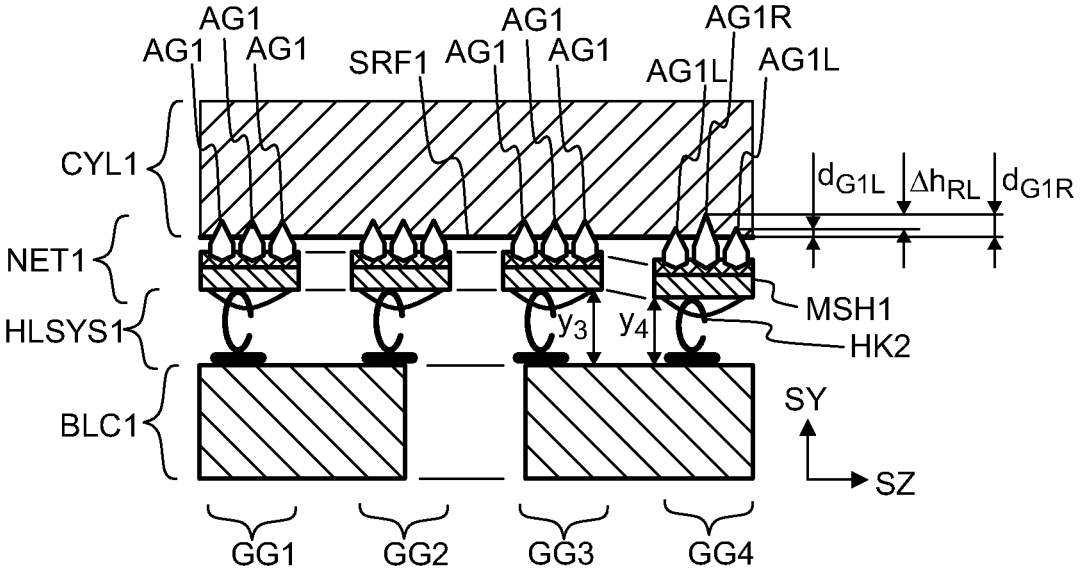
FIG. 15 shows, by way of example, operation of an abrasive mesh article in a situation where the peak of an abrasive grain is at a higher level than the peaks of the adjacent grains.

However, referring to FIG. 15, the peak of an abrasive grain AG1R may sometimes be at a substantially higher level than the peaks of adjacent grains AG1L. The high grain AG1R may be called e.g. as a rider grain.

As a comparative example, in case of a conventional rigid honing stone, a rider grain may cut an excessively deep groove, and/or may damage the cylinder surface.

In case of the abrasive module 100, the combination of the flexible abrasive mesh NET1 and the compressible hooks HK2 may at least partly compensate the effect of a high grain AG1R. The hook or hooks HK2 beneath the high grain AG1R may be compressed so as to compensate the increased height of the grain AG1R.

The abrasive mesh NET1 may comprise a plurality of groups (GG1, GG2, GG3, GG4, . . . ) of abrasive grains AG1. The peaks of grains of a first group GG3 may be substantially at the same height level. A second group GG4 may comprise a high grain AG1R and adjacent grains AG1L. The symbol $\Delta h_{RL}$ denotes the height difference between the height level of the peak of a high grain AG1R and the height level of the peaks of adjacent grains AG1L. The height difference $\Delta h_{RL}$ may also be called e.g. as the amount of protrusion. The high grain AG1R may form a groove G1, which has a depth $d_{G1R}$. An adjacent grain AG1L may form a groove G1, which has a depth $d_{G1L}$. The height difference $\Delta h_{RL}$ may also be so large, that the adjacent grains AG1L do not touch the cylinder surface SRF1.

$y_3$ denotes the distance between the collector block BLC1 and a first backing portion, which supports the first group GG3 of grains AG1. $y_4$ denotes a distance between the collector block BLC1 and a second backing portion, which supports the second group GG4 of grains AG1. The hooks HK2 beneath the first group GG3 and the beneath the second group GG4 may be compressed when the abrasive mesh NET1 is pressed against the cylinder surface SRF1. At least one hook HK2 beneath the second group GG4 may be compressed slightly more than the hooks HK2 beneath the first group GG3. The second distance $y_4$ may be slightly smaller than the first distance $y_3$, in a situation where the abrasive mesh NET1 is pressed against the cylinder surface SRF1.

The flexible backing MSH1 of the abrasive mesh NET1 may adopt a doubly curved shape to compensate the effect of a high grain and/or in order to conform to small geometric deviations of the cylinder surface.

Figure 16:
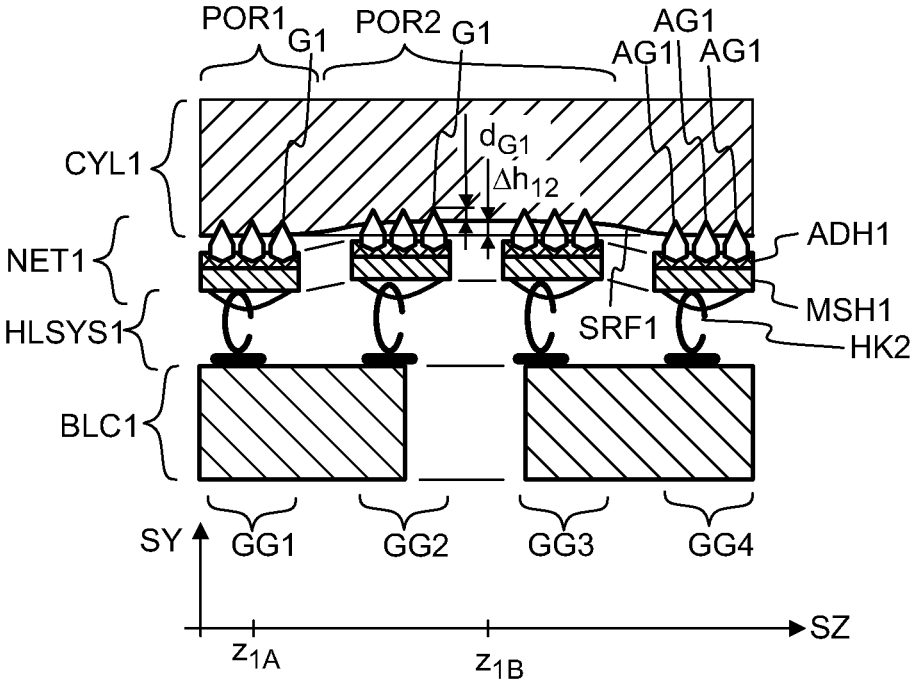
FIG. 16 shows, by way of example, operation of an abrasive mesh article in a situation where the real shape of the cylinder surface slightly deviates from the perfect cylindrical shape.

Referring to FIG. 16, a cylinder may exhibit small deviations, which may be within the acceptable manufacturing tolerances. The cylinder may have portions which may exhibit double curvature. The abrasive mesh may conform to the shape of the cylinder. The abrasive mesh may rapidly conform to the geometric shape of the cylinder, even in a situation where the cylinder would comprise doubly curved portions.

The abrasive grains may be supported by the mesh structure and by the hooks HK2 in a slightly resilient manner, such that the individual grains or a small group grains may rapidly follow the radial position of the surface of the cylinder. The abrasive mesh may conform to the geometric shape of the cylinder, even in a situation where the geometric shape of the cylinder would slightly deviate from the perfect cylindrical form.

For example, the initial surface SRF1 of the cylinder may comprise e.g. a (slightly) protruding portion PORI and a (slightly) depressed portion POR2 before forming the groove pattern. The radius of curvature $r_{SRF1}$ of the cylinder surface SRF1 at a first axial position $z_{1A}$ may be e.g. slightly smaller than the radius of curvature $r_{SRF1}$ of the cylinder surface SRF1 at a second axial position $z_{1B}$B. Depending on the manufacturing tolerances, the difference $\Delta h_{12}$ between the radial positions of the portions POR1, POR2 may be e.g. smaller than 1 μm.

The abrasive mesh NET1 may be supported by the resilient hooks HK2. The hooks HK2 may generate a pressure (i.e. force per unit area), which presses the abrasive mesh NET1 against the cylinder surface SRF1. The height of the supporting hooks HK2 may be e.g. in the range of 0.5 mm to 3 mm. The deviation $\Delta h_{12}$ may be negligible when compared with the height of the supporting resilient hooks HK2. Consequently, the pressure generated beneath the portion POR1 may be substantially equal to the pressure generated beneath the portion POR2. The resilient hooks HK2 may provide substantially constant pressing forces, which may cause the abrasive mesh MSH1 to conform to the cylinder surface SRF1. The average depth $d_{G1}$ of the grooves G1 formed on the depressed portion POR2 may be substantially equal to the average depth $d_{G1}$ of the grooves G1 formed on the protruding portion POR1.

Figure 17:
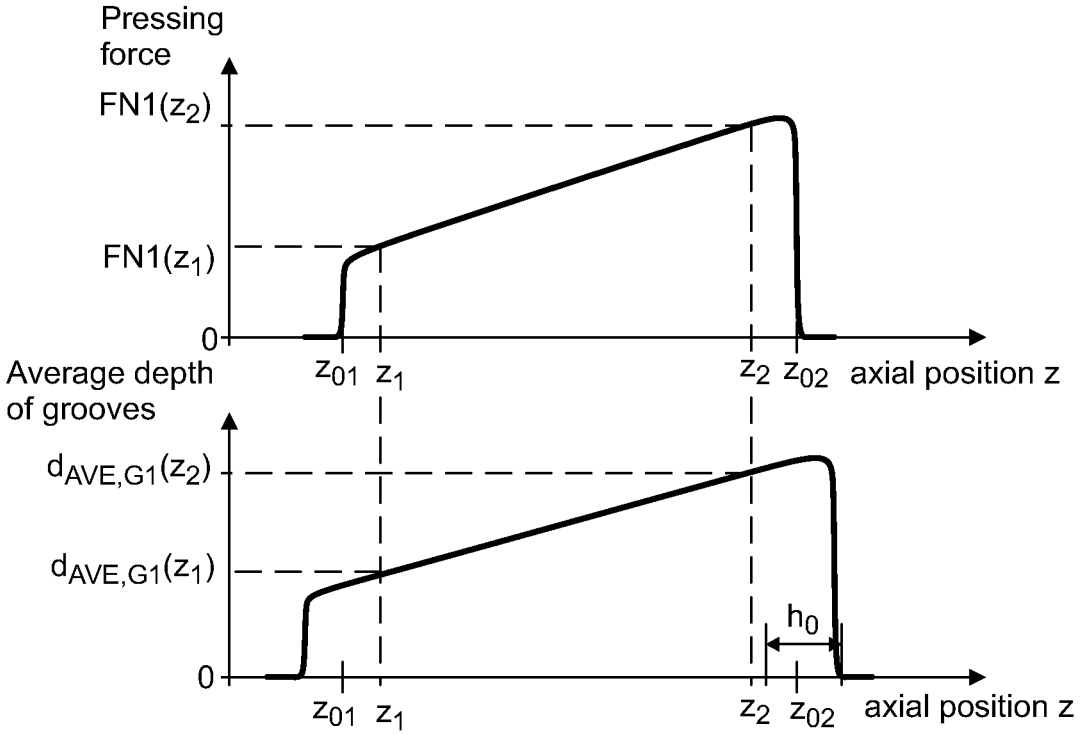
FIG. 17 shows, by way of example, varying the pressing force as a function of axial position, and the average depth of the produced grooves as a function of axial position.
Figure 18:
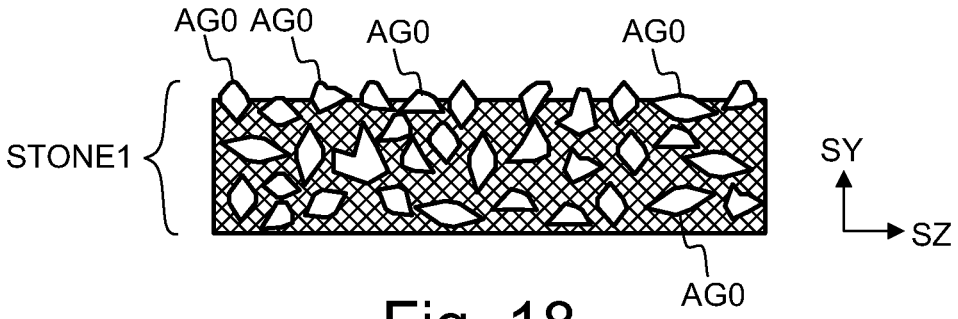
FIG. 18 shows a conventional honing stone.

Referring to FIG. 17, the method may comprise varying the pressing force FN1 as the function of axial position of the patterning head, so that the depth of the produced grooves may depend on the axial position in a desired manner.

The average depth $d_{AVE,G1}$ of the grooves G1 of the groove pattern PAT1 may depend on the axial position z. The average depth $d_{AVE,G1}$ of the grooves G1 may be expressed e.g. as a depth function $d_{AVE,G1}(z)$ of the axial position Z. The grooves may be formed according to a desired depth function by varying the pressing force FN1 as a function of the axial position z. The average depth of the grooves at the different axial positions may be selected e.g. in order to optimize lubricating properties of the oil film and/or in order to optimize the consumption of lubricating oil.

For example, the average depth $d_{AVE,G1}(z_1)$ of the grooves G1 at a first axial position $z_1$ may be substantially different from the average depth $d_{AVE,G1}(z_2)$ of the grooves G1 at a second axial position $z_2$. The first position $z_1$ may be e.g. the bottom dead center (BDC) position of the piston, and the second position $z_2$ may be e.g. the top dead center (TDC) position of the piston. The average depth $d_{AVE,G1}(z_2)$ at the TDC position may be e.g. greater than 1.3 times the average depth $d_{AVE,G1}(z_1)$ at the BDC position. The average depth $d_{AVE,G1}(z_2)$ at the TDC position may be e.g. greater than 1.5 times the average depth $d_{AVE,G1}(z_1)$ at the BDC position. The average depth $d_{AVE,G1}(z_2)$ at the TDC position may be e.g. greater than 2.0 times the average depth $d_{AVE,G1}(z_1)$ at the BDC position.

The method may comprise producing the grooves such that the average depth of the grooves near the top dead center position of the piston is greater than the average depth of the grooves near the bottom dead center position of the piston, so as to optimize lubricating properties of the oil film.

$h_0$ may denote the height of the abrasive articles 110. The pressing force FN1 may be optionally reduced at the axial positions $z_{01}$, $z_{02}$, e.g. in order to avoid producing horizontal groove portions. The pressing force FN1 may have a reduced value outside the axial range defined by the axial positions $z_{01}$, $z_{02}$. The reduced value may be e.g. smaller than 10% of the maximum value of the pressing force FN1. The reduced value may be e.g. smaller than 1% of the maximum value of the pressing force FN1.

Referring back to FIG. 2, the method may optionally comprise a phase, where the abrasive mesh articles 100 are moved axially with little or no tangential velocity component. This phase may be used to shorten or replace running-in of an engine ICE1.

The apparatus 500 may be arranged to process the surface SRF1 of the cylinder CYL1 in order to supplement a running in operation of an engine ICE1 and/or in order to replace a running in operation of an engine ICE1. The method may comprise grinding the surface SRF1 by using an abrasive mesh NET1, which has fine abrasive grains AG1. The grit size of the abrasive grains AG1 may be e.g. in the range of 240 to 1200. The method may comprise moving the abrasive modules 100*a*, 100*b*, 100*c* along a path PTH1 such that the angle between the direction of the path PTH1 and the axial direction AX1 is e.g. smaller than 45°.

The method may be carried out in normal atmosphere, wherein the released particles may be carried by air. However, the method may also be carried out e.g. in a nitrogen atmosphere or in an argon atmosphere. The method may comprise removing the released particles by drawing gas through the abrasive mesh articles and through the collecting blocks to a dust suction apparatus VCU1. The term "air" (AIR1) may also refer to any gas, e.g. to nitrogen or argon.

In an embodiment, the hooks (or loops) may be attached directly to the surface of the block BLC e.g. by welding, by using an adhesive, and/or by permanently inserting a part of the hook into the material of the block.

In an embodiment, a reversed orientation of the hook and loop fastening system may be used, i.e. the loops may be attached to the block BLC, and the hooks may be permanently attached to the abrasive mesh NET1.

In an embodiment, the flow direction of the air AIR1 may be reversed. The reversed air flow may blow the released particles away from the abrasive mesh NET1 and/or the reversed air flow may cool the abrasive grains. The apparatus may be arranged to blow air via the blocks BLC to the abrasive mesh NET1 during forming of the grooves G1, G2 such that the air flow may blow the released particles RP1 away from the abrasive mesh NET1.

In an embodiment, the cylinder surface SRF1 may also be lubricated and/or cooled with a liquid during forming the grooves G1, G2. The liquid may comprise or consist of oil.

In an embodiment, a liquid may be guided to the cylinder surface SRF1 via the block BLC and via the openings of the abrasive mesh NET1. The liquid may comprise or consist of oil. The liquid may be guided to the cylinder surface SRF1 also as an aerosol via the block BLC and via the openings of the abrasive mesh NET1.

Additional cleaning may be needed to remove the liquid and the released particles from the cylinder after the grooves have been formed.

A fluid may be guided from the openings OP1 to the openings OP3 via the fastening system HLSYS1 and/or a fluid may be guided from the openings OP3 to the openings OP1 via the fastening system HLSYS1. The fluid may be gas. The fluid may be a mixture of gas and liquid. The fluid may be an aerosol.

For the person skilled in the art, it will be clear that modifications and variations of the devices and the methods according to the present invention are perceivable. The figures are schematic. The particular embodiments described above with reference to the accompanying drawings are illustrative only and not meant to limit the scope of the invention, which is defined by the appended claims.

The invention claimed is:

1. A method for producing a groove pattern on a cylinder surface, the method comprising:

providing an abrasive module, which comprises an abrasive mesh article and a collector block, providing a patterning head, which comprises the abrasive module and a pressing actuator, pressing the abrasive module against the cylinder surface by using the actuator, forming a plurality of grooves on the cylinder surface by causing relative motion between the abrasive module and the cylinder surface, and drawing gas through the abrasive mesh article to remove particles released from the cylinder surface, wherein the abrasive mesh article comprises a plurality of abrasive grains bonded to a flexible mesh backing, the collector block has a curved supporting surface, the radius of curvature of the curved supporting surface of the collector block is selected according to the radius of curvature of the cylinder surface, such that the radius of curvature of the abrasive module substantially corresponds to the radius of curvature of the cylinder surface, the abrasive mesh article is removably attached to the collector block, the abrasive mesh article is attached to the curved supporting surface by a releasable fastening system, which comprises hooks removably attached to loops, the flexible mesh backing comprises a plurality of first openings, the curved supporting surface comprises a plurality of second openings, and wherein the first openings are in communication with the second openings via the releasable fastening system, for providing pathways for the released particles from the first openings to the second openings via the releasable fastening system.

2. The method of claim 1, wherein the number density of the openings of the abrasive mesh article is in the range of 10 to 2000 holes per $cm^2$.

3. The method of claim 1, wherein the abrasive module has a leading edge of an abrasive mesh article and a trailing edge of an abrasive mesh article, and wherein an angular distance between the leading edge and the trailing edge is in the range of 15° to 110°.

4. The method of claim 1, wherein the cylinder surface is dry during forming the groove pattern.

5. The method of claim 1, comprising forming a first groove pattern on a first cylinder surface by using a first abrasive article, removing the first abrasive article from the collector block after forming the first groove pattern, attaching a second abrasive article to the collector block after removing the first abrasive article, and forming a second groove pattern on a second cylinder surface by using the second abrasive article.

6. The method of claim 1, comprising varying a pressing force of the actuator as a function of axial position of the abrasive module, wherein an average depth of the grooves at a top dead center position is substantially different from the average depth of the grooves at a bottom dead center position.

7. The method of claim 1, wherein the patterning head comprises a group of abrasive mesh articles, and wherein the groove pattern is formed such that the abrasive mesh articles of the group travel over each point of the groove pattern not more than 100 times.

8. The method of claim 1, wherein the cylinder surface has an axis, the method comprising rotating the patterning head and/or the cylinder about the axis, and moving the rotating patterning head and/or the cylinder in the direction of the axis.

9. The method of claim 8, wherein the rotation has an angular velocity, the axial movement has an axial velocity, and the ratio of the axial velocity to the angular velocity is selected such that the orientation angle of the formed grooves is in the range of 30° to 85°, wherein the orientation angle of a groove is the angle between said groove and the direction of the axis.

10. The method of claim 9, wherein the ratio of the axial velocity to the angular velocity is selected such that the orientation angle of the formed grooves is in the range of 50° to 75°.

11. The method of claim 1, comprising forming a groove pattern on the cylinder surface by using one or more first abrasive articles, and removing protrusions from the cylinder surface by using one or more second abrasive articles, wherein the average size of the abrasive grains of the first abrasive articles is larger than the average size of the abrasive grains of the second abrasive articles.

12. The method of claim 11, wherein the grit size of the abrasive grains of the first abrasive articles is in the range of 60 to 120, and wherein the grit size of the abrasive grains of the second abrasive articles is in the range of 180 to 400, wherein the grit sizes are determined according to the standards FEPA 43-1:2006 and FEPA 43-2:2006.

13. The method of claim 12, wherein the grit size of the abrasive grains of the first abrasive articles is 80.

14. The method of claim 12, wherein the grit size of the abrasive grains of the second abrasive articles is 240.

15. An apparatus for forming a groove pattern on a cylinder surface, the apparatus comprising:

a patterning head, a rotating unit to cause relative rotational motion between the patterning head and the cylinder surface, a positioning unit to cause relative axial motion between the patterning head and the cylinder surface, and a suction unit configured to draw gas through an abrasive mesh article to remove particles released from the cylinder surface, wherein the patterning head comprises an abrasive module and a pressing actuator to press the abrasive module against the cylinder surface, wherein the abrasive module comprises a collector block and the abrasive mesh article attached to a curved supporting surface of the collector block by a releasable fastening system, wherein the radius of curvature of the curved supporting surface of the collector block is selected according to the radius of curvature of the cylinder surface, such that the radius of curvature of the abrasive module substantially corresponds to the radius of curvature of the cylinder surface, the abrasive mesh article comprises a plurality of abrasive grains bonded to a flexible mesh backing, the abrasive mesh article comprises a plurality of first openings, the collector block comprises a plurality of second openings, and the first openings are in communication with the second openings via the releasable fastening system.

16. The apparatus of claim 15, comprising a control unit configured to control an axial velocity component of the abrasive module and/or a pressing force of the pressing actuator as a function of axial position of the abrasive module.

17. The apparatus of claim 15, comprising a control unit configured to control a pressing force of the pressing actuator, wherein the control unit is configured to temporarily reduce the pressing force at an end region of a longitudinal movement of the abrasive module.

* * * * *